US011794058B2

(12) United States Patent
Ballestero

(10) Patent No.: US 11,794,058 B2
(45) **Date of Patent: *Oct. 24, 2023**

(54) COLLAPSIBLE HIP THRUST EXERCISE APPARATUS

(71) Applicant: BOOTYSPROUT, INC., Novato, CA (US)

(72) Inventor: Michael Ballestero, Novato, CA (US)

(73) Assignee: BOOTYSPROUT VENTURES, LLC, Novato, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/403,829

(22) Filed: Aug. 16, 2021

(65) Prior Publication Data

US 2022/0032108 A1 Feb. 3, 2022

Related U.S. Application Data

(63) Continuation of application No. 16/138,848, filed on Sep. 21, 2018, now Pat. No. 11,135,464.

(Continued)

(51) Int. Cl.
*A63B 21/04* (2006.01)
*A63B 23/02* (2006.01)

(Continued)

(52) U.S. Cl.
CPC .... *A63B 21/0414* (2013.01); *A63B 21/00065* (2013.01); *A63B 21/0552* (2013.01);

(Continued)

(58) Field of Classification Search
CPC ..... A63B 23/0222; A63B 23/0211; A63B 23/0482
See application file for complete search history.

(56) References Cited

U.S. PATENT DOCUMENTS 1,623,670 A 4/1927 Frankenfeld
2,759,730 A * 8/1956 Berry ..... A63B 23/0211 482/145

(Continued)

FOREIGN PATENT DOCUMENTS

DE 29800505 U1 3/1998
WO 2008077117 A1 6/2008

OTHER PUBLICATIONS

Thane(Im) Booty Maxx, "Introducing Booty Maxx," retrieved from https://bootymax.com.au/; published by Danoz Direct Ply Ltd.; accessed on May 6, 2020; original publication date unknown; 3 pgs.

(Continued)

*Primary Examiner* — Megan Anderson
(74) *Attorney, Agent, or Firm* — WOMBLE BOND DICKINSON (US) LLP

(57) ABSTRACT

Embodiments of a collapsible, user-friendly weighted hip thrust exercise apparatus are provided. The apparatus may include a base frame enclosing an exercise space, with an upper body support attached to one end of the frame. The frame may be adjustable in length and/or width in order to accommodate different users. The upper body support provides an elevated back rest for the user, and may be adjustable in height. A user may sit down in the exercise space enclosed by the frame with the user's upper-back and arms resting on top of the upper body support, placing his or her feet on top of the frame on the other width side. The apparatus may further feature a central resistance band positioned at the user's hip line, coupled to side handles or multiple attachment points, and detent pins to removably lock the apparatus in place for use.

13 Claims, 26 Drawing Sheets

Related U.S. Application Data

(60) Provisional application No. 62/574,094, filed on Oct. 18, 2017.

(51) Int. Cl.
*A63B 21/055* (2006.01)
*A63B 23/04* (2006.01)
*A63B 21/00* (2006.01)

(52) U.S. Cl.
CPC ..... *A63B 21/0557* (2013.01); *A63B 21/4009* (2015.10); *A63B 21/4037* (2015.10); *A63B 23/0211* (2013.01); *A63B 23/0222* (2013.01); *A63B 21/4033* (2015.10); *A63B 23/0482* (2013.01); *A63B 2208/0252* (2013.01); *A63B 2209/00* (2013.01); *A63B 2210/50* (2013.01); *A63B 2225/09* (2013.01)

(56) References Cited

U.S. PATENT DOCUMENTS 4,102,336 A * 7/1978 Wiener ..... A61H 1/0218 606/241
4,282,868 A * 8/1981 Riggs ..... A61H 1/0218 606/241
4,332,381 A 6/1982 Lyons
4,371,162 A 2/1983 Hartzell
4,863,163 A 9/1989 Wehrell
4,968,028 A 11/1990 Wehrell
4,982,958 A 1/1991 Ullman
5,551,934 A 9/1996 Binette
5,645,510 A 7/1997 Wilkinson
6,206,809 B1 3/2001 Habing et al.
6,220,994 B1 * 4/2001 Rich ..... A63B 23/03508 482/130
6,299,669 B1 10/2001 Rich
6,387,024 B1 5/2002 Monti et al.
7,431,681 B1 10/2008 St. Cyr
D590,457 S 4/2009 Mishan
7,608,025 B1 10/2009 Best
7,739,775 B2 6/2010 Shimanski
7,951,054 B2 5/2011 Snow et al.
8,172,736 B2 5/2012 Contreras
8,465,403 B2 6/2013 McCall, Jr.
D700,792 S 3/2014 Melton
9,061,172 B1 6/2015 Carrier
9,199,110 B2 12/2015 Jones
9,630,055 B2 4/2017 Runyan
9,737,750 B2 * 8/2017 Garcia Lopez .... A63B 21/0442
9,782,619 B2 10/2017 Wang
9,782,622 B2 10/2017 Hornback
9,974,999 B2 5/2018 Land
10,179,258 B1 1/2019 Sabbagh
10,220,236 B2 3/2019 Oltorik, Jr.
10,512,811 B2 12/2019 Barber
10,610,728 B2 4/2020 Fano et al.
2003/0004042 A1 1/2003 Burrell
2003/0083178 A1 5/2003 Gilman
2004/0053757 A1 3/2004 Chung
2006/0019806 A1 1/2006 Mikulski
2006/0199706 A1 9/2006 Wehrell
2007/0087920 A1 4/2007 Dachraoui et al.
2008/0214369 A1 9/2008 Mancini
2010/0016132 A1 1/2010 Flynn
2010/0323857 A1 12/2010 D'Silva et al.
2011/0021329 A1 1/2011 Dunne
2011/0218077 A1 9/2011 Fernandez et al.
2011/0251033 A1 10/2011 Blancher
2012/0115692 A1 5/2012 Bussen et al.
2012/0244997 A1 9/2012 Thompson
2013/0244835 A1 9/2013 Thompson
2014/0066262 A1 3/2014 Kennedy
2014/0113773 A1 4/2014 Marghella
2014/0113780 A1 4/2014 Emmert
2014/0155232 A1 6/2014 Wolan
2014/0287894 A1 9/2014 Austin
2017/0056708 A1 3/2017 Kelly
2017/0304677 A1 * 10/2017 Clinton ..... A63B 21/4047
2018/0304112 A1 10/2018 Shih
2018/0318641 A1 11/2018 Lootsma
2022/0118308 A1 * 4/2022 Park ..... A63B 21/4039

OTHER PUBLICATIONS

Yukon International, "Butt & Thigh Shaper," retrieved from https://www.yukon-fitness.com/products/butt-thigh-shaper-1; published by Yukon Fitness; retrieved on May 7, 2020; original publication date unknown; 4 pgs.
Body-Solid Inc., "Powerline Glute Max—PGM200X," retrieved from https://www.bodysolid.com/home/pgm200x/powerline_glute_max; retrieved on May 7, 2020; original publication date unknown; 1 pg.
Larsen, Haakon A., "BootyBuilder(R)—The original hip thrust machine" retrieved from https://bootybuilder.com/shop/;publication date unknown; Norway; accessed on May 7, 2020; original publication date unknown; 3 pgs.
EPO—International Search Report for related Int'l. Appln. No. PCT/US2019/021180, dated May 24, 2019, 3 pgs.
EPO—Written Opinion for related Int'l. Appln. No. PCT/US2019/021180, dated May 24, 2019, 3 pgs.
Bootysprout, Inc., "BootySprout High Resistance at-home glute training." retrieved from https://web.archive.org/web/20180824114900/hllps://www.bootysprout.com/; published Aug. 6, 2018; retrieved on Apr. 15, 2020; 2 pgs.
Bretcontreras Store, "BC Strength Thruster Lite" retrieved from https://www.bretcontreras.store/collections/allproducts-services/products/thruster-lite-fitness-product; publication dale unknown; accessed on Apr. 26, 2020, 3 pgs.

* cited by examiner

COLLAPSIBLE HIP THRUST EXERCISE APPARATUS

CROSS-REFERENCE TO RELATED APPLICATIONS

This application is a continuation of U.S. patent application Ser. No. 16/138,848, filed Sep. 21, 2018, which claims the benefit of priority to U.S. Provisional Patent Application No. 62/574,094, filed Oct. 18, 2017, the entire disclosures of which are hereby incorporated by reference in their entireties.

TECHNICAL FIELD

Adjustable, collapsible hip thrust exercise apparatus devices using resistance bands specially positioned to exercise the gluteal muscles.

BACKGROUND

There are many fitness apparatuses designed to work out the gluteal muscles and/or lower body, and many of them require access to a gym as they are bulky and expensive. There are also several apparatuses designed for in-home use, such as the BootyMax™, Butt and Thigh Shaper™, Glute Max™ etc. While some of these products do use resistance bands, none of these products replicate the exercise in the present invention, which is the barbell hip thrust exercise. There do exist hip thrust apparatuses, such as the Hip-Thruster™ and the BootyBuilder™, however these products are bulky, non-collapsible, and not adequately designed for in-home use.

Regarding the instant invention, the barbell hip thrust is an effective method for isolated gluteal muscle exercise. This exercise requires the user to sit on the ground with his or her back raised against a bench, feet planted firmly in front of the body, and a barbell resting on their lower abdomen. The user then raises the barbell by extending the hips and pushing the hips upward with the gluteal muscles. This motion continues until the body forms a straight line from shoulders to knees. The feet position at the beginning of the exercise must be at a distance away from the user such that when the user is at the top of the flexed position, the lower legs are about perpendicular to the ground.

The user then lowers the barbell back towards the ground to complete one repetition. While this exercise is effective, it is time-consuming and difficult to set up and perform, and it has safety risks. Existing fitness apparatuses meant to simplify the exercise are bulky and not adequately designed for in-home use.

SUMMARY

The instant invention provides a collapsible, elegantly engineered weighted hip thrust exercise apparatus. Various embodiments of the present invention may consist of a base frame enclosing an exercise space, with an upper body support attached to one end of the frame. The frame may be adjustable in length and/or width in order to accommodate different users. The upper body support may be configured to provide an elevated back rest for the user. In an illustrative example, the upper body support height may be adjustable to accommodate different users. In an exemplary scenario illustrative of various embodiments' usage, a user may sit down in the exercise space enclosed by the frame with the user's upper-back and arms resting on top of the upper body support, placing his or her feet on top of the frame on the other width side. The apparatus may further feature a central resistance band positioned at the user's hip line, coupled to side handles or multiple attachment points, and detent pins to removably lock the apparatus in place for use.

In various embodiment implementations, resistance bands may be attached to the frame via an attachment mechanism, at a location(s) on each length side. In a preferred embodiment, the resistance bands are attached to the frame near the center of the length side, specially positioned to isolate the gluteus maximus muscles. In an illustrative example, a user may then connect each resistance band from each length side together over the user's abdomen via an attachment mechanism, enabling the user to perform weighted hip thrusts, with the user's body weight applied by their feet and upper-back to keep the frame on the ground. In an illustrative example, the user may attach additional resistance bands in order to increase the difficulty of the exercise.

DETAILED DESCRIPTION OF ILLUSTRATIVE EMBODIMENTS

Various aspect of the present invention embody a collapsible, more user-friendly weighted hip thrust exercise apparatus. As discussed in the summary, in various exemplary scenarios, a barbell hip thrust exercise may require the user to sit on the ground with his or her back against a bench, feet planted firmly in front of the body, and a barbell resting on their lower abdomen. In some examples, the user may then raise the barbell by extending the hips and pushing the hips upward with the gluteal muscles. In an illustrative example, this motion may continue until the body forms a straight line from shoulders to knees.

In one embodiment, the feet position at the beginning of the exercise must be at a distance away from the user such that when the user is at the top of the flexed position, the lower legs are approximately perpendicular to the ground. In such an example, the user may then lower the barbell back towards the ground to complete one repetition.

The barbell hip thrust provides several challenges to a user as they must place weight on their lower abdomen in order to increase the difficulty and effectiveness of the exercise. This process is difficult, time-consuming, and has safety risks.

In various illustrative scenarios, some embodiments of the present invention may solve these difficulties and risks by providing users with an apparatus that is collapsible when not in use, quick to set up, and easy to use, without sacrificing effectiveness. Some embodiments of the present invention may include a tubular rectangular frame with attached resistance bands, enclosing an exercise space, with an upper body support that is connected pivotally. In an illustrative example, in various embodiment designs, the shape of the frame is not limited to rectangular, as in some embodiments, the frame has curved corners.

For example, in some embodiments, the shape of the frame may require a space in the middle. In an illustrative example, in some embodiments, the shape of the frame around the space in the middle may be more circular than rectangular. In various embodiments designs, the tubing implementing the frame and other parts of the apparatus are not limited to a specific type and/or shape of tubing. For example, the tubing may be circular, square, or rectangular.

Figure 11:
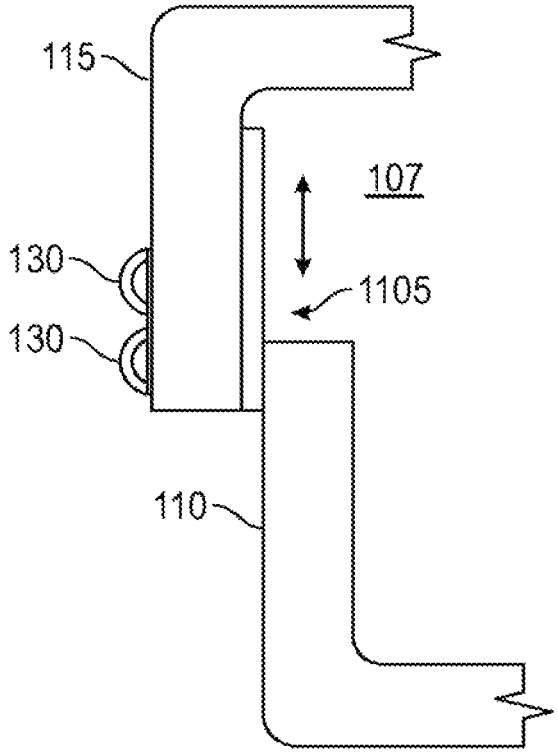
FIG. 11 is a top view of one length side of an exemplary rectangular frame of an illustrative exercise apparatus according to various embodiments of the present invention.
Figure 12:
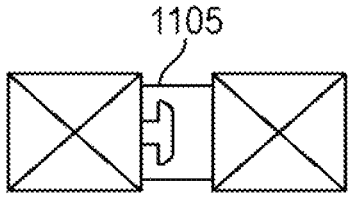
FIG. 12 is a frontal view of one length side of an exemplary rectangular frame of an illustrative exercise apparatus according to various embodiments of the present invention. Note the X on the tube represents a cross section of the length side of the rectangular frame.

In some embodiments, the frame may be adjustable in length and/or width in order to accommodate different users. In an illustrative example, adjusting the length and/or width of the frame may be achieved through telescopic tubing (See FIGS. 1D, 2), or via a slider 1105 connecting the two tubes (See FIG. 11,12). In the embodiment depicted by FIG. 1D, the exemplary collapsible hip thrust exercise apparatus 105 includes the frame 107. In the embodiment illustrated by FIG. 1D, the frame 107 includes the first frame section 110 pivotally engaged with the second frame section 115. In the embodiment illustrated by FIG. 1D, the resistance band 120 is attached via handles 130 at both sides of the frame 107.

Figure 1A:
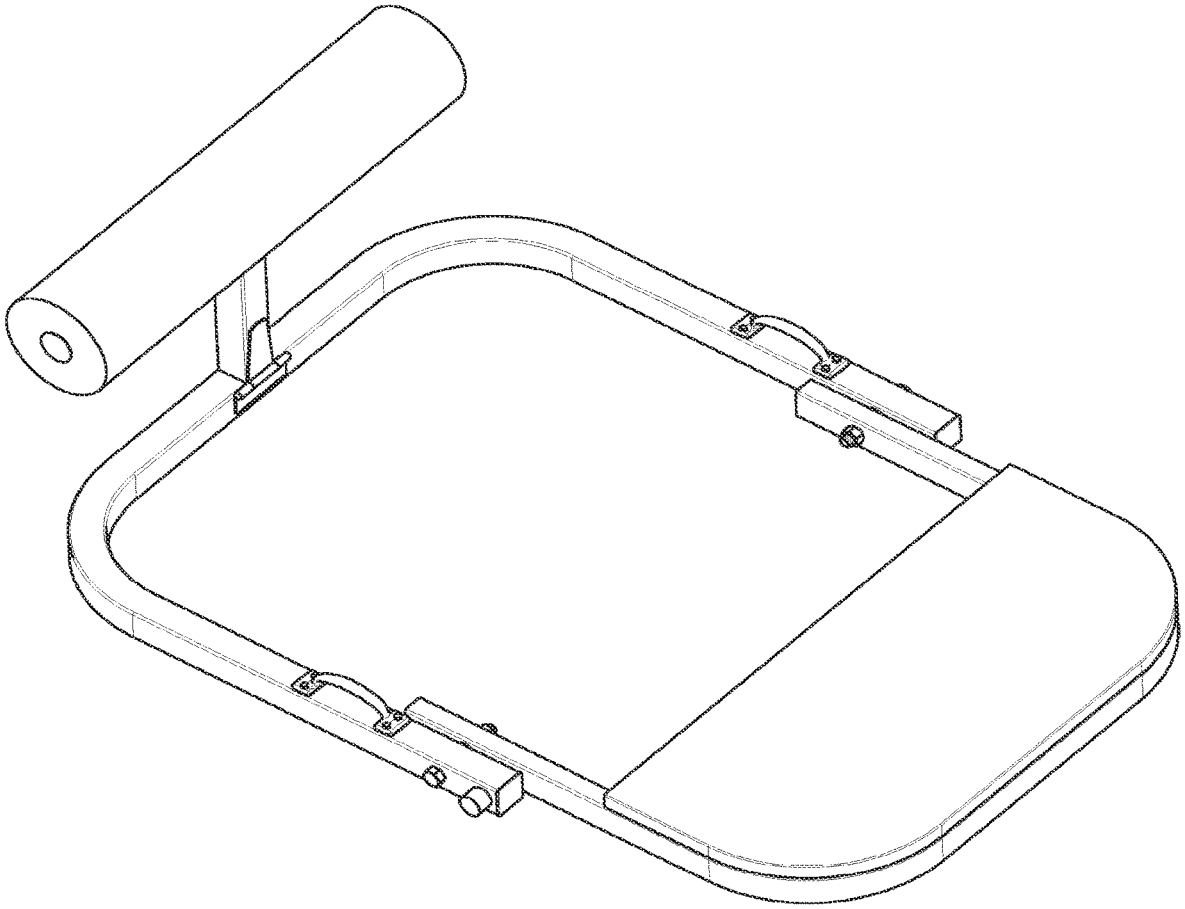
FIG. 1A is a perspective view of an exemplary exercise apparatus according to various embodiments of the present invention.
Figure 1B:
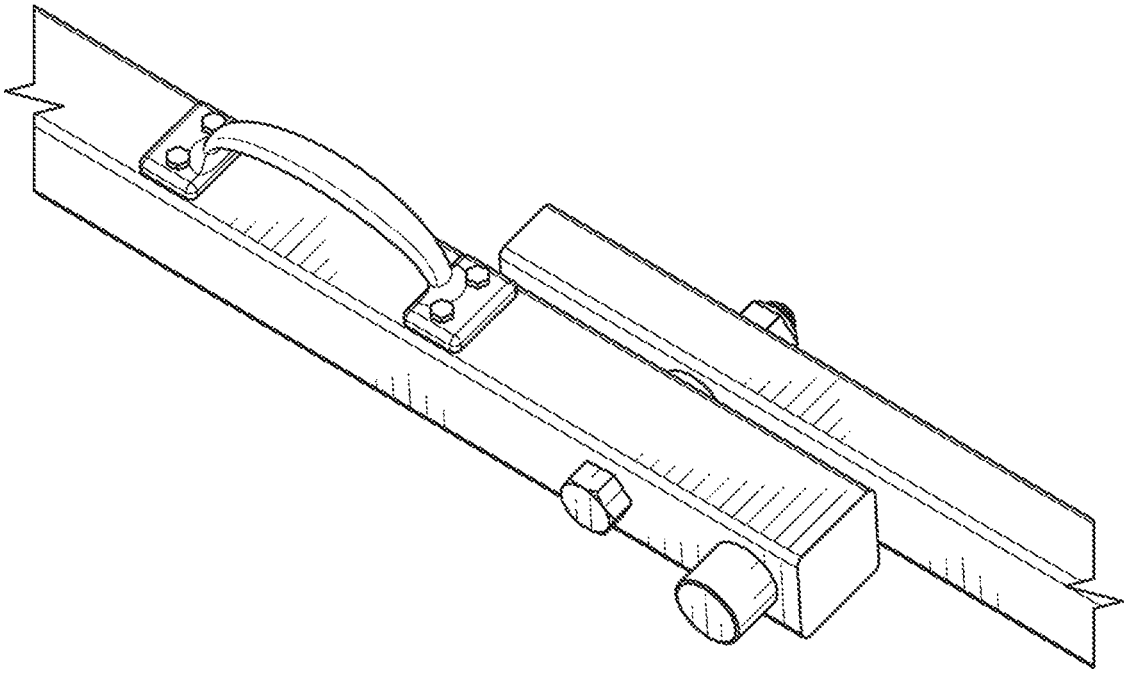
FIG. 1B is a perspective view of part of an exemplary base frame with an index plunger locking the pivotally connected tubes in place.
Figure 1C:
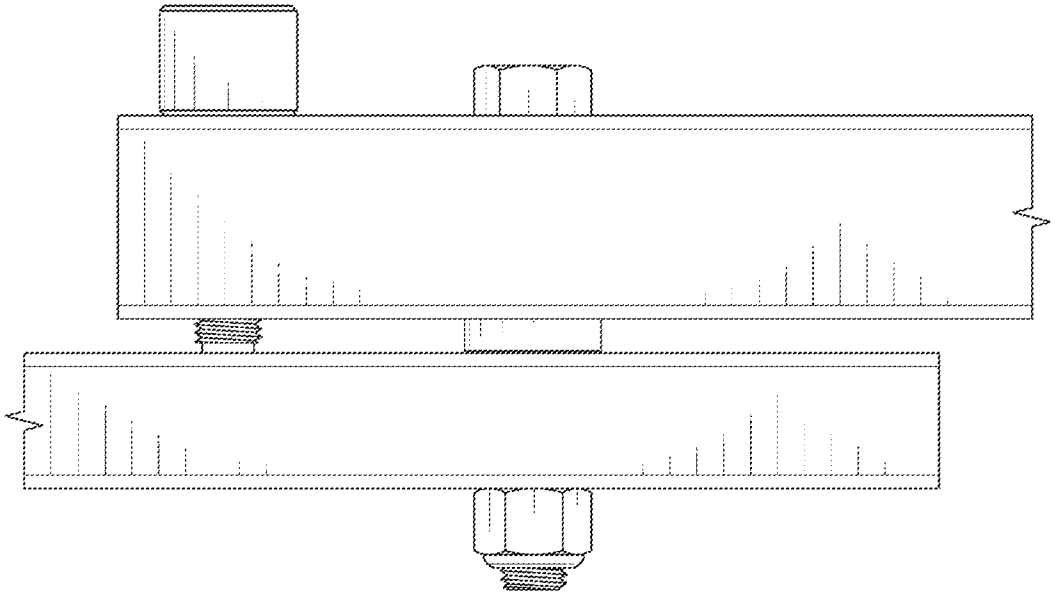
FIG. 1C is a top view of part of an exemplary base frame with an index plunger locking the pivotally connected tubes in place.
Figure 1D:
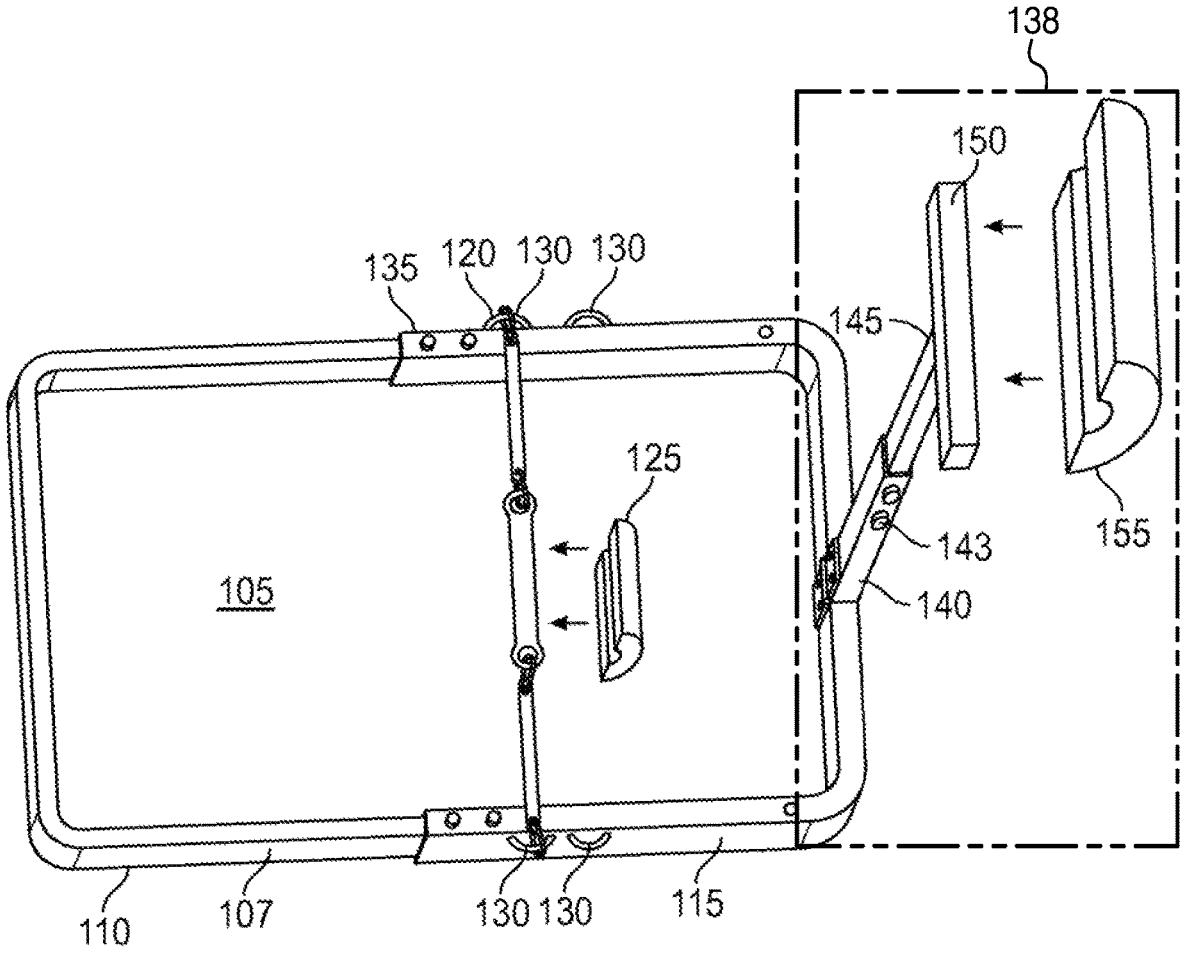
FIG. 1D is a perspective view of an exemplary exercise apparatus according to various embodiments of the present invention.
Figure 2:
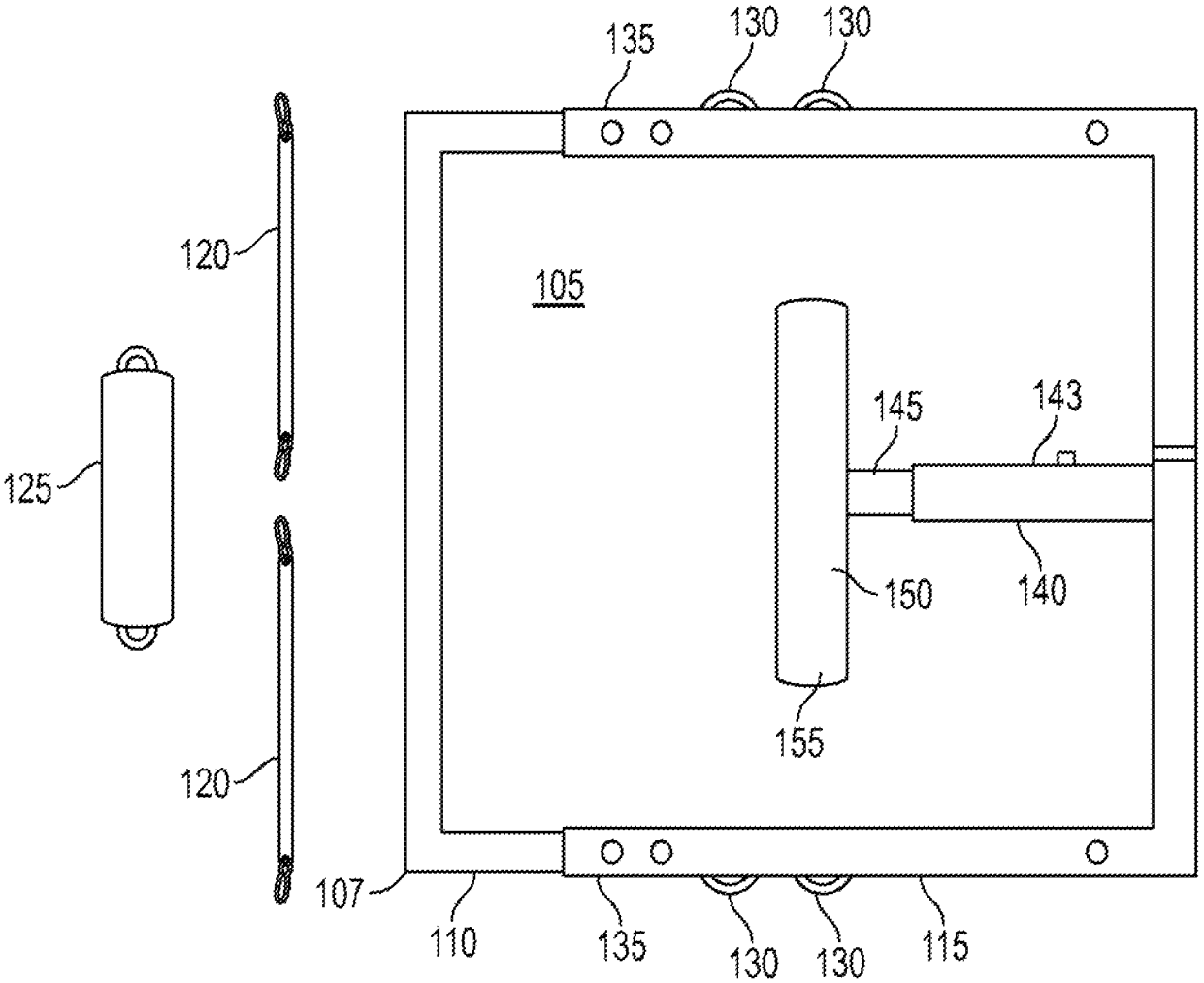
FIG. 2 is a top view of an exemplary exercise apparatus according to various embodiments of the present invention, where the apparatus is fully collapsed.

In the embodiment depicted by FIG. 1D, the removable padded sleeve 125 is configured to substantially encase the resistance band 120. In the embodiment depicted by FIG. 1D, the frame hinges 135 pivotally engage the first frame section 110 with the second frame section 115.

In the embodiment illustrated by FIG. 1D, the upper body support lower section 140 is adjustably engaged via the upper body support lock 143 with the upper body support upper section 145. In the embodiment depicted by FIG. 1D, the upper body support cross-member 150 is configured to include the upper body support head rest 155. In the embodiment depicted by FIG. 2, the upper body support is depicted in a folded configuration.

In some embodiments, in order to minimize the area that the frame encloses when not in use, a first portion of the frame may connect pivotally with a second portion of the frame, thus allowing the frame to fold on itself (See FIGS. 14A-14B, and FIGS. 15A-15B). In different embodiments, pins used to lock the folded frame in place (FIG. 16) may be attached or detached. In various embodiments, the pin may be spring-loaded. In different embodiments, pins and/or push button and hole configurations for locking the adjusted length in to place may vary. In alternate embodiments, said tubes may be removably locked by magnets, gate-latches, securing slots, securing notches, hook&loop fasteners, pins, press-fit, or by the friction of the interlocking tubes themselves as sleeved or angled.

For example, in some embodiment implementations, using push buttons for telescopic tubing can be placed on top of, or on either side of the tube. The slider orientation may also vary in different embodiments, as one tube may slide across the top, bottom, or either side of the other tube. A cam lock may also be used in some embodiments to lock telescoping tubing. In an illustrative example, the foot and/or feet of the user may be placed on the frame opposite the upper body support. In some embodiments, a foot support may be attached to the frame (See FIGS. 15A-15B). In an illustrative example exemplary of various embodiments' usage, the foot support may provide an area for the user to place his or her feet and allow some embodiments of the apparatus to accommodate varying user heights.

In some embodiments, the upper body support may provide an elevated back rest for the user. In various embodiments, the upper body support may be adjustable in height to accommodate different users. In some embodiments, the upper body support may be located in the center of one of the width sides of the frame. In some embodiment designs, the upper body support may be connected pivotally with the frame, and thus may be rotated to a more horizontal position within the frame and minimize the vertical footprint of the apparatus when not in use (See FIG. 2). In various embodiments upper body support rotation may be achieved through a hinge attached to the support, with a push button to stop rotation and keep the support fixed upright (See FIG. 1, and FIGS. 7A-7B).

Figure 4:
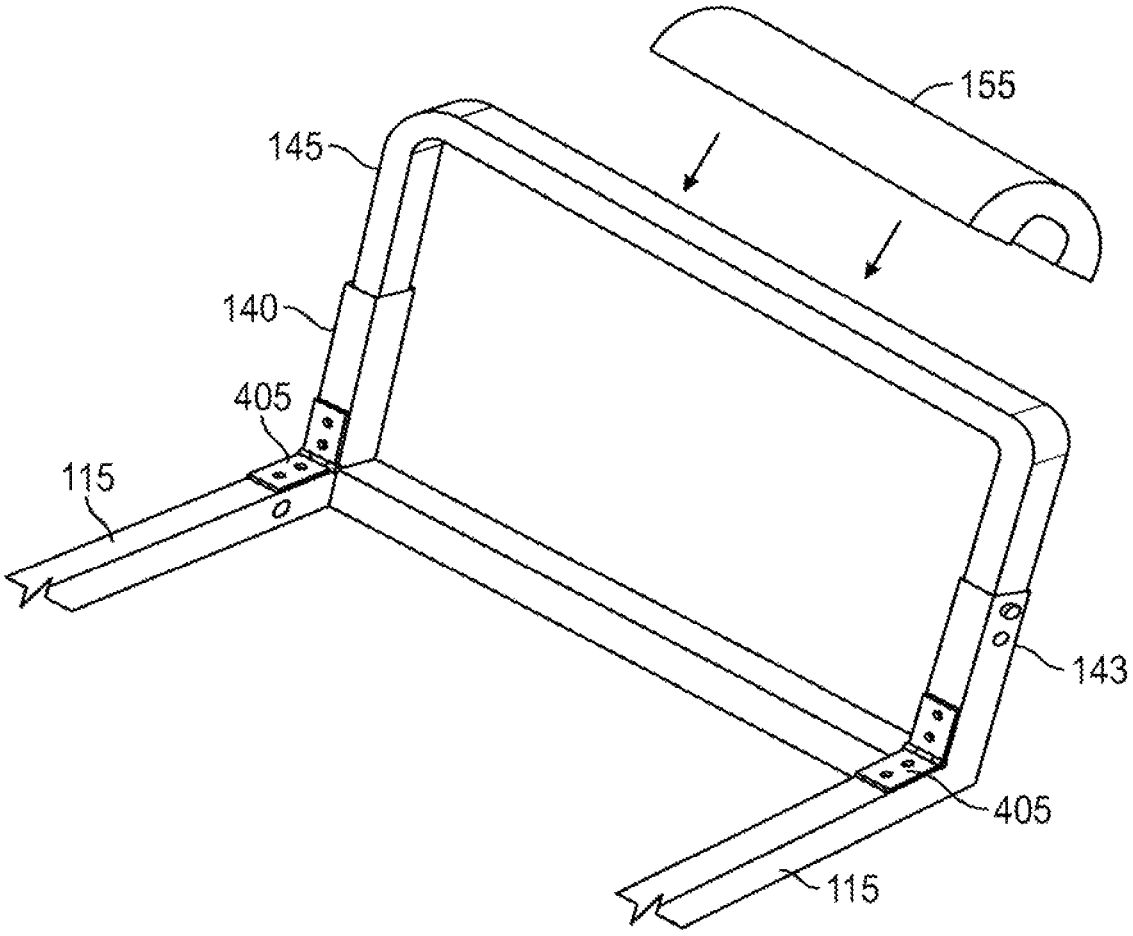
FIG. 4 is a perspective view of an exemplary upper body support for an illustrative exercise apparatus according to various embodiments of the present invention.
Figure 5A:
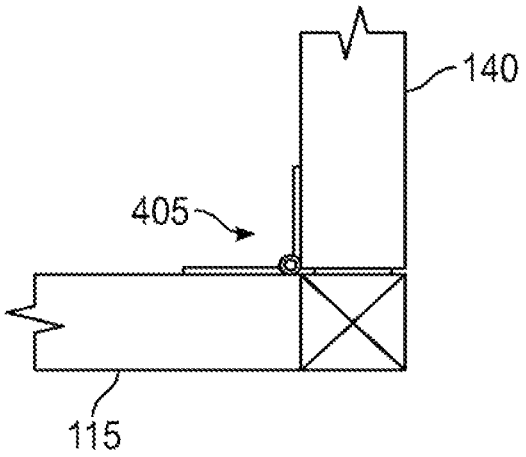
FIGS. 5A-5B are side views of an exemplary upper body support for an illustrative exercise apparatus according to various embodiments of the present invention. Note the X on the tube represents a cross section of the width side of the rectangular frame.
Figure 5B:
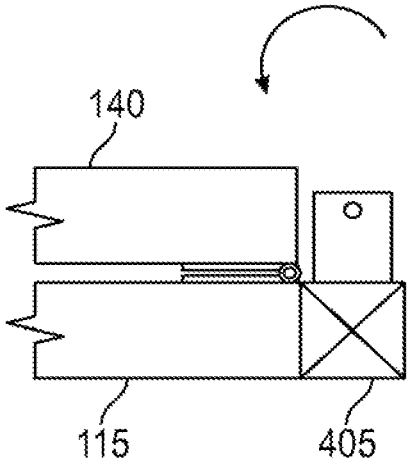
Figure 6A:
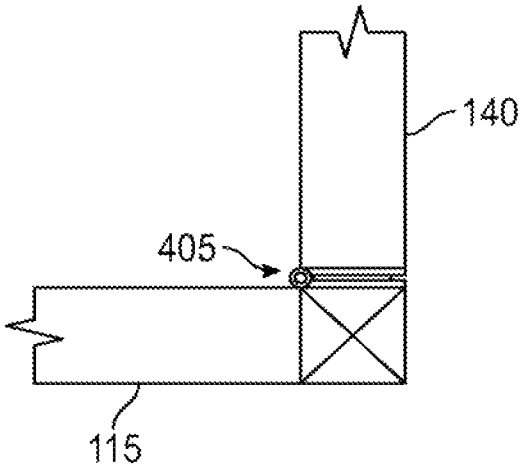
FIGS. 6A-6B are side views of an exemplary upper body support for an illustrative exercise apparatus according to various embodiments of the present invention. Note the X on the tube represents a cross section of the width side of the rectangular frame.
Figure 6B:
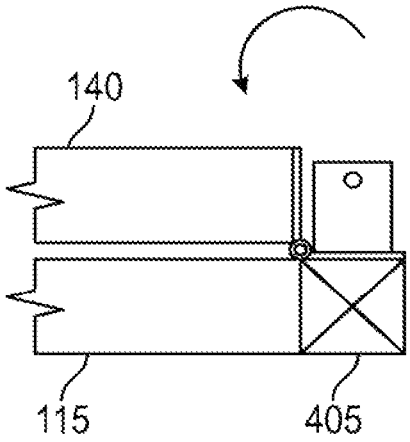
Figure 10A:
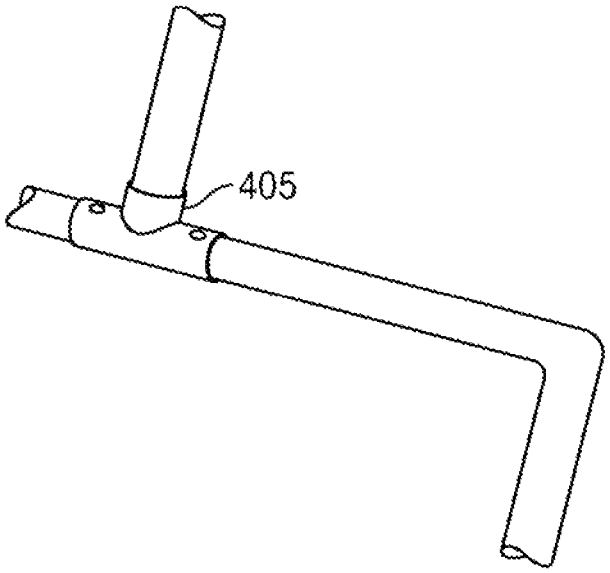
FIGS. 10A-10B are perspective views of an exemplary upper body support for an illustrative exercise apparatus according to various embodiments of the present invention.
Figure 10B:
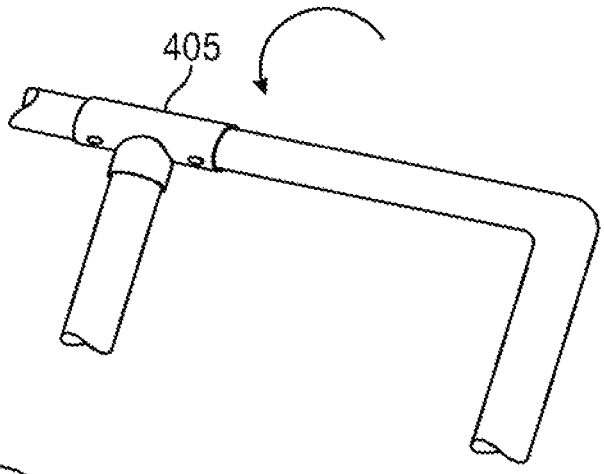

In various embodiment implementations, the support may rotate around a circular tube on a 3-way fitting (See FIGS. 10A-10B) with the use of push buttons to stop rotation and keep the support in an upright position. In some embodiments, the upper body support may consist of a square or circular tube shaped to form a wide U, that may be as wide as the length sides of the frame, (See FIG. 4). In an illustrative example depicted by FIG. 4, the support may be attached pivotally to each end of the width side of the frame. In various embodiments, the support may be attached with upper body support hinges 405 to the end of the width side of the frame with the points of the U facing down onto the frame, so that it may fold down (See Figs. SA-SB, and FIGS. 6A-6B). In an example illustrative of various embodiment designs, several different hinge mechanisms may be used to fold down the upper body support, some of which but not limited to are presented below (See FIGS. 7A-7B, FIGS. 8A-8B, and FIGS. 9A-9B).

Figure 13:
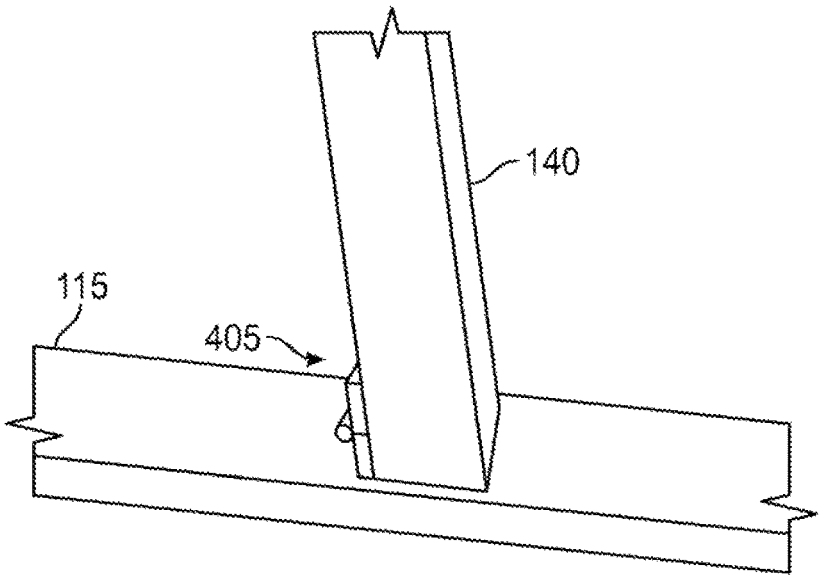
FIG. 13 is a perspective view of an exemplary upper body support for an illustrative exercise apparatus according to various embodiments of the present invention.
Figure 14A:
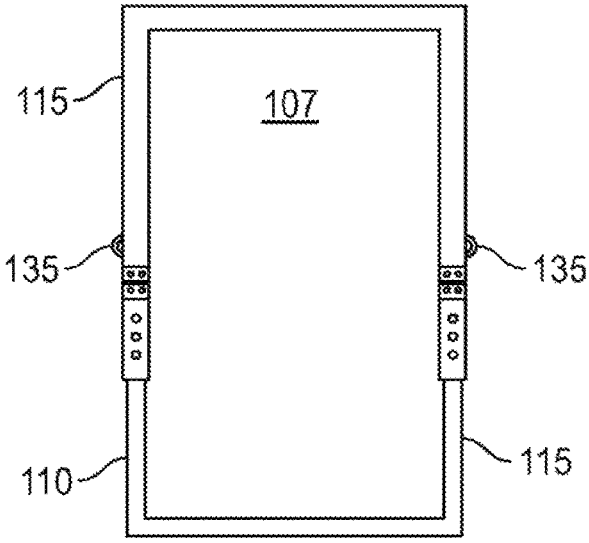
FIGS. 14A-14B are top views of an exemplary rectangular frame for an illustrative exercise apparatus that is connected pivotally according to various embodiments of the present invention, in both an open and folded configuration. Note that an upper body support is not depicted in this figure, but if it were, would be attached to the top side of the rectangular frame from this view.
Figure 14B:
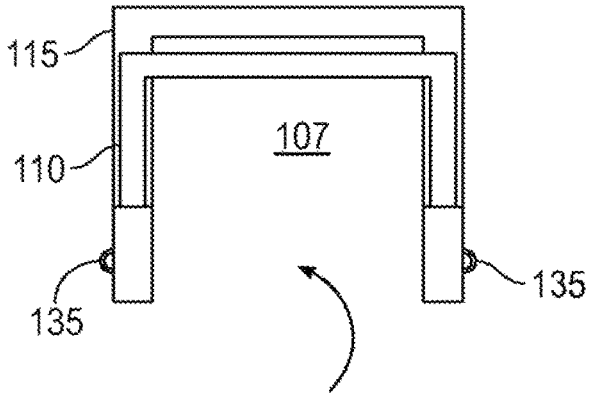

For example, there exist folding leg brackets configured with locking mechanisms both in the open and closed positions that may also be used to attach the upper body support. In some embodiment implementations, the upper body support may also be a separate attachment from the apparatus, and may be screwed in, connected via a hole and push button, or other attachment method that allows for easy separation. (See FIG. 13).

Figure 3A:
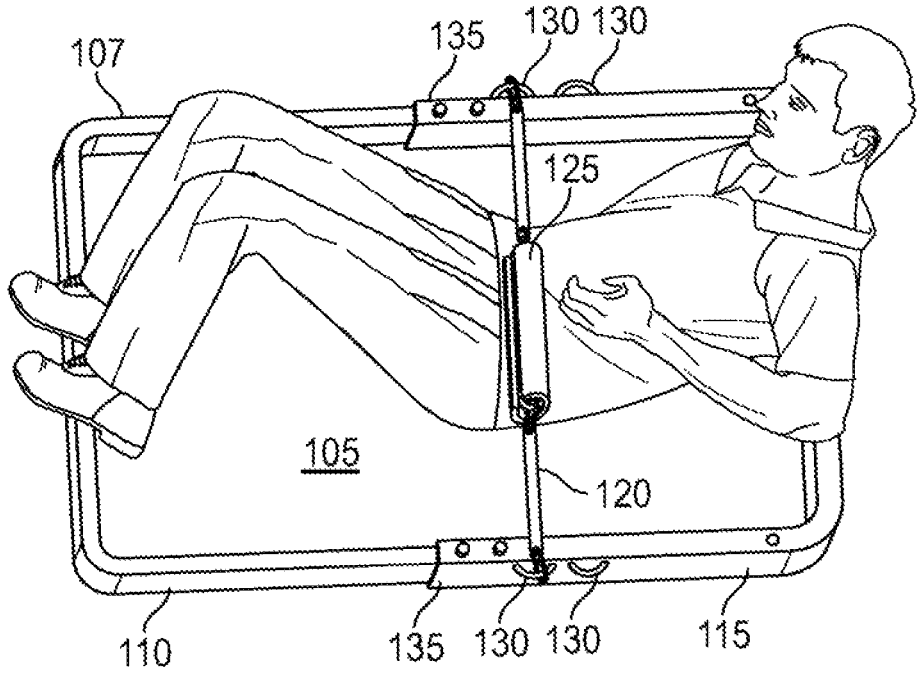
FIGS. 3A-3B are perspective views of a person using an exemplary exercise apparatus according to various embodiments of the present invention.

In some embodiment designs, resistance bands may be attached to the frame at an attachment point, at a location(s) on each length side, and may be located on the top of, or either side of the frame. In various embodiments, the resistance bands may have a carabiner on each end. In an example illustrative of various embodiment implementations, the placement of the attachment point(s) on or to the frame may be adjustable. In some embodiments, an attachment point may be in the form of a loop, ring, or handle attached to the tubing. In an example illustrative of various embodiment designs, a handle attachment point may be attached to the frame via welding, screws, or another fastening method. In some embodiments, the resistance bands may be attached to the frame in a fixed location in the center of the length side (See FIG. 1D). In an exemplary scenario illustrative of some embodiment designs' usage, a user may sit down in the exercise space enclosed by the frame with the user's upper-back and arms resting on top of the upper body support and placing his or her feet on top of the frame on the other width side (See FIG. 3A). In some embodiment usage scenarios, a user may connect each resistance band from each length side together over the user's abdomen via an attachment mechanism. In various embodiment usage scenarios, a user may connect one resistance band from one length side to the other length, with the band resting on the user's abdomen.

Figure 3B:
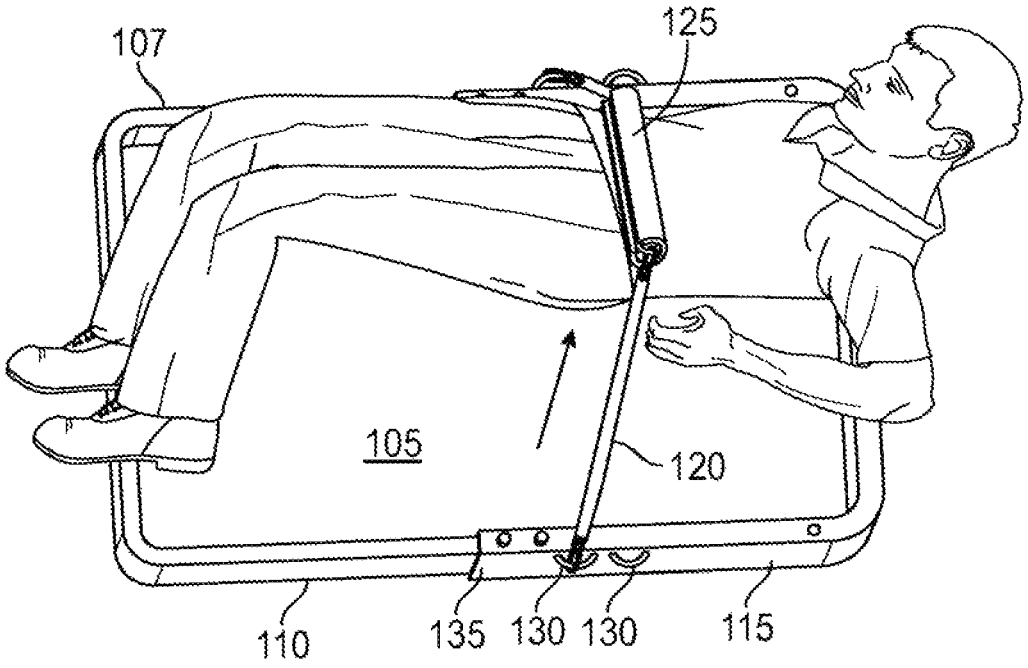

In an illustrative example, a padded sleeve may be used to cover the resistance bands and/or attachment mechanism that rest on the abdomen. In an example illustrative of various embodiments' usage, a user may perform weighted hip thrusts (See FIGS. 3A-3B), with the user's body weight applied by their feet and upper-back to keep the frame on the ground. For example, the user may attach additional resistance bands in order to increase the difficulty of the exercise.

In some embodiments as to be presently described (FIG. 1D), the frame may be rectangular. In the embodiment depicted by FIG. 1D, the frame has an adjustable length and a fixed width. In the embodiment illustrated by FIG. 1D, the length is adjustable from 27 inches to 42 inches and the width is 30 inches. In the embodiment illustrated by FIG. 1D, the rectangular frame consists of two sizes of tubing, so that one can be placed within the other and can move freely, known as telescopic tubing. In the embodiment depicted by FIG. 1D, the first size of tubing is 1.25×1.25 inch 14 gauge square tubing, and the second size is 1.5×1.5 inch 14 gauge square tubing. In an example illustrative of various embodiment designs and depicted by FIG. 1D, each tube is shaped to form a U, with each open end of the smaller U tube fitting into the open ends of the larger U tube. In an illustrative example, the sides where the two tubes connect are the length sides. In some embodiment designs, push buttons facing up are placed in the smaller tube on the sides of each open end. The U type frame, also telescopic tube frame, therein provides an upper body support, connected pivotally to the back end of the base frame and protruding upwards with the top of the support at least 30 cm from a surface on which the base frame rests, the support being thus foldable to a position wherein the distance from the surface where the base frame rests to the highest point of the support is no more than (e.g.) 22 cm.

The resistance apparatus therefore connects to the base frame on both sides, wherein the resistance apparatus is placed within (e.g.) 25 cm on either side of the hip line of the user, said hip line customarily being and exercise space surface on which the base frame rests, said surface enclosed by the front-proximal end, back end, and the sides of the base frame.

In various embodiment implementations, holes that have a larger diameter than the push buttons are placed on the top of the larger tube on the sides of each open end. In an illustrative example, the smaller tube may now slide into the larger tube until a push button reaches a hole and the tube is locked in place, at which point the user may push the button(s) down to further adjust the length of the rectangular frame. In some embodiments, to minimize the footprint of the apparatus for storage, the smaller tube may slide as far as is permitted into the larger tube, where it can be locked in place with another push button, as depicted, for example, in FIG. 2.

In some embodiments, resistance bands may be attached to the frame at an attachment point(s). In an example illustrative of various embodiment implementations, the attachment point(s) may include two rings with an inner diameter of approximately 1 inch and a thickness of approximately 5/16 inch secured to each open ended side of the larger tube, on the outside of the tube, pointing away from the user (proximal end). In various embodiment designs, the attachment point rings may be welded to the tube. In some embodiment design implementations, the resistance bands may include a carabiner attachment on each end, allowing the user to attach the resistance band to the ring.

In some embodiments, one end of each resistance band may be attached to the ring on either side of the rectangular frame, while the other resistance band end is attached to an approximately 5/16 inch ring that is connected to a substantially square metal tube of similar dimensions as the smaller tubing used in the frame. In an illustrative example, this tube may have two rings on each end, and the tube length in this embodiment from ring tip to ring tip is approximately 12 inches. In some embodiment implementations, the tube may be enclosed with padding, which serves to provide comfort to the user's abdomen (See FIGS. 1, 2).

In various embodiment designs, the upper body support may include the same two sizes of rectangular metal tubing that form the frame. In some embodiment designs, the lower half of the support may be formed by a larger tube, while a smaller tube may be placed inside of the larger tube to form the upper half of the support. In an example illustrative of various embodiment implementations, the support height may range from approximately 14 inches to approximately 18 inches.

In some embodiment designs, the smaller tube may have two push buttons facing out, and the larger tube may have two holes that accommodate the push buttons. In an illustrative example, as with the length of the rectangular frame, the upper body support may be adjustable in height, with the smaller tube sliding down the larger tube until the push button enters the hole. In various embodiment implementations, the smaller tube may be further slid down by pushing the first push button in.

In some embodiment designs, a horizontal rectangular tube may be attached to the top of the upper body support, parallel with the width of the rectangular frame. In an example illustrative of various embodiment implementations, this horizontal rectangular tube may be attached to the smaller vertical tube of the upper body support and may be similar in size to the larger rectangular tubing used in this embodiment. In various embodiment designs, the width of the tube may be approximately 2 feet. In an example illustrative of some embodiment implementations, as with the resistance band attachment that may rest on the user's abdomen, the horizontal tube may be enclosed in padding to provide comfort for the user's back. In an illustrative example, this support should rest under the upper back of the user.

Figure 7A:
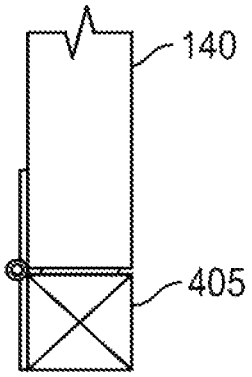
FIGS. 7A-7B are side views of an exemplary upper body support for an illustrative exercise apparatus according to various embodiments of the present invention. Note the X on the tube represents a cross section of the width side of the rectangular frame.
Figure 7B:
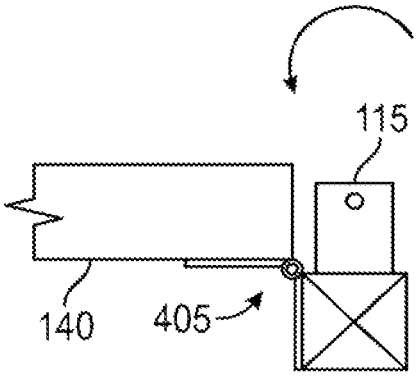
Figure 8A:
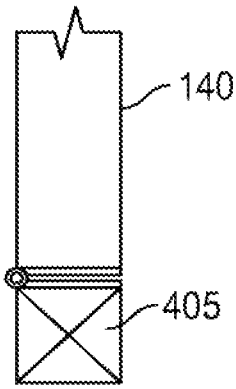
FIGS. 8A-8B are side views of an exemplary upper body support for an illustrative exercise apparatus according to various embodiments of the present invention. Note the X on the tube represents a cross section of the width side of the rectangular frame.
Figure 8B:
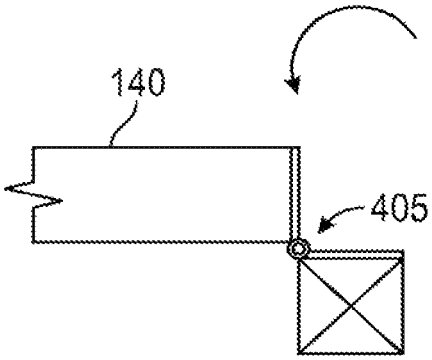
Figure 9A:
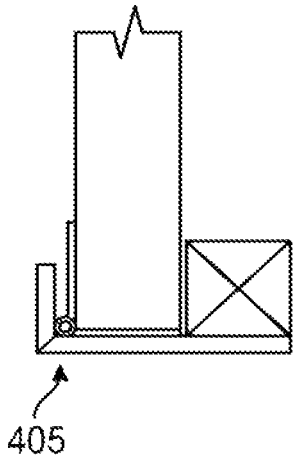
FIGS. 9A-9B are side views of an exemplary upper body support for an illustrative exercise apparatus according to various embodiments of the present invention. Note the X on the tube represents a cross section of the width side of the rectangular frame.
Figure 9B:
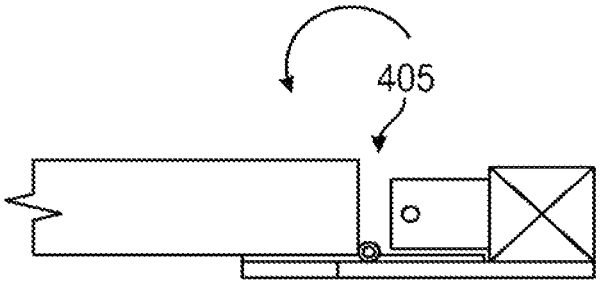

In the embodiment depicted by FIGS. 7A-7B, the upper body support pivotally attaches to the rectangular frame via a butterfly hinge, and when upright, the upper body support protrudes from the top of the center of the width of the rectangular frame on the side having the larger tube. In the embodiment illustrated by FIGS. 7A-7B, the upper body support rests on top of the rectangular frame when the upper body support is upright, however the upper body support is not attached. In the embodiment depicted by FIGS. 7A-7B, the hinge is bolted to the upper body support near the bottom of the side facing inward towards the exercise space. In the embodiment illustrated by FIGS. 7A-7B, the hinge is also bolted to the rectangular frame on the side facing inwards. In the embodiment depicted in FIGS. 7A-7B, a push button is placed near the bottom of the upper body support. In the embodiment illustrated by FIGS. 7A-7B, a rectangular piece of metal is attached to the width of the rectangular frame on the upper body support side. In the embodiment depicted by FIGS. 7A-7B, the rectangular piece of metal is welded to the rectangular frame and protrudes upwards from the frame. In the embodiment illustrated by FIGS. 7A-7B, the rectangular piece of metal attached to the rectangular frame is placed directly next to the upper body support when the support is upright. In the embodiment depicted by FIGS. 7A-7B, a hole is placed in the rectangular piece of metal attached to the rectangular frame, so that when the upper body support is in its upright position, the push button attached to the upper body support enters the hole, thus locking the support in place. In an illustrative example, a user can then push the button in and fold down the upper body support, so that it rests inside the exercise space, in the same plane as the rectangular frame. The above frame may alternatively be sliding tubes or telescopic tubes, so long as the ultimate structure remains collapsible.

Figure 16:
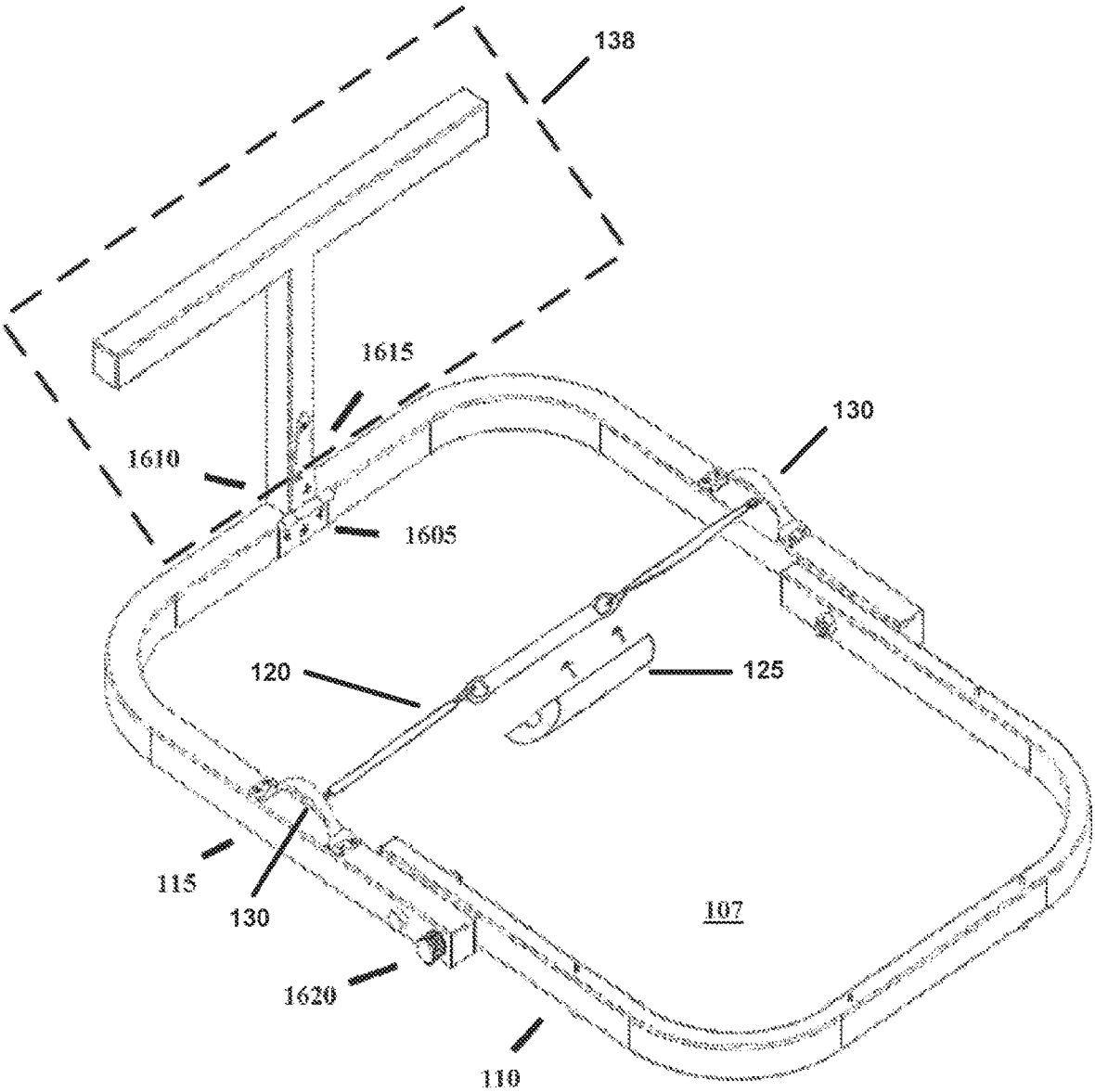
FIG. 16 is a perspective view of an exemplary exercise apparatus according to various embodiments of the present invention. The resistance tubes, as well as the added foot support, are not depicted in this figure.
Figure 17:
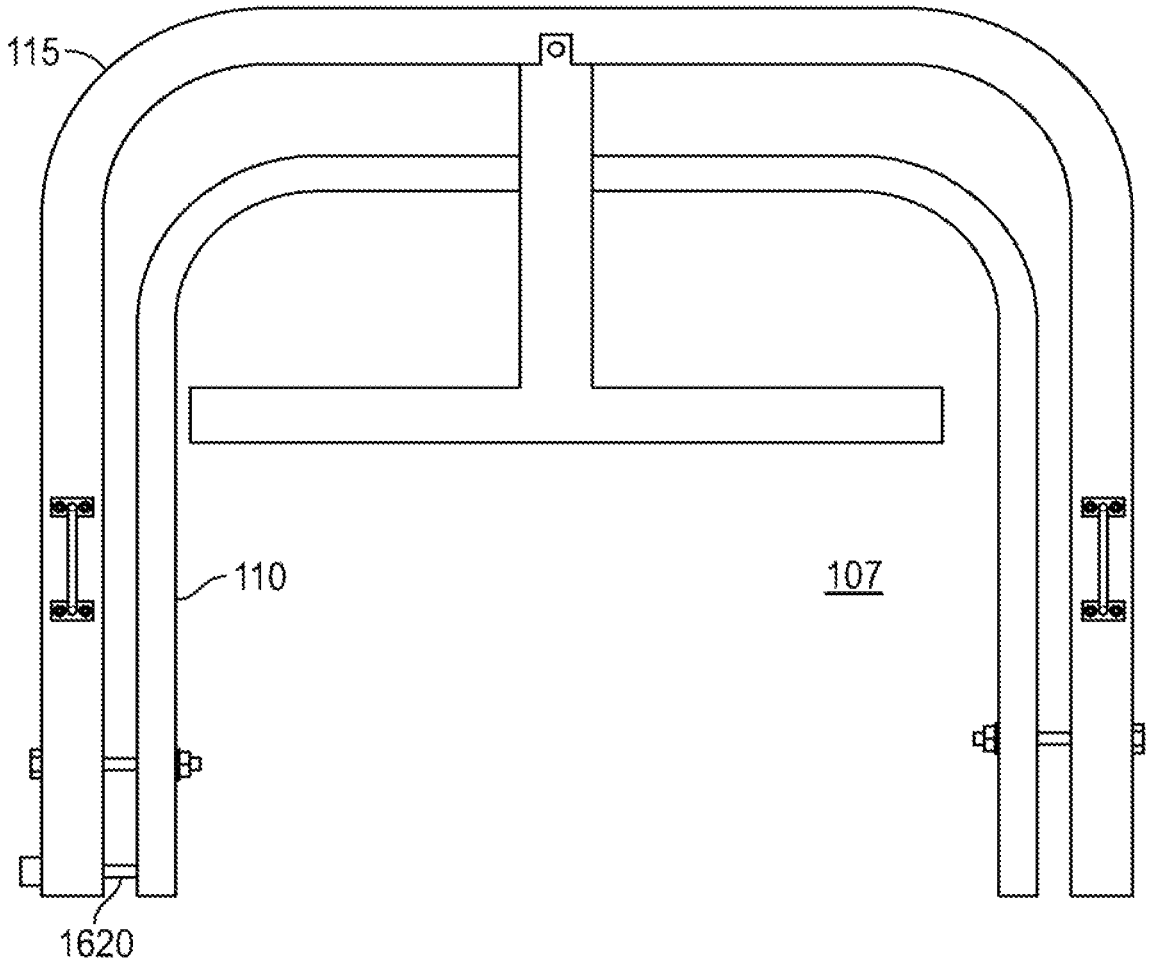
FIG. 17 is a top view of an exemplary exercise apparatus when folded up, according to various embodiments of the present invention. The resistance tubes, as well as the foot support, are not depicted in this figure.

In another embodiment of the present invention, depicted in FIG. 16 and to be presently described, the rectangular frame with curved corners has a changeable length and a fixed width. In the embodiment depicted by FIG. 16, the frame length is 39.5 inches when the frame is unfolded, and the width is 29 inches. In the embodiment illustrated by FIG. 16, the base frame includes two sizes of tubing. In the embodiment depicted by FIG. 16, the first size of tubing is 1.5×1 inch 16 gauge rectangular tubing, and the second size of tubing is 1.5×1.5 inch 16 gauge square tubing. In the embodiment illustrated by FIG. 16, each tube is shaped to form a U, with the square tubing having a width of 29 inches and a length of 24 inches, and the 1.5×1 inch tubing having a width of 25.5 inches and a length of 21.5 inches. In the embodiment depicted by FIG. 16, the two U shaped tubes are connected pivotally, with both open ends facing each other and overlapping by 6 inches and form the base frame. In the embodiment illustrated by FIG. 16, the base frame when unfolded forms a rectangular-shaped frame with curved corners, and when folded forms a shape similar to a C, with a length of 24 inches, as illustrated by, for example, FIG. 17. In the embodiment illustrated by FIG. 16, the base frame 107 includes the index plunger method of adjustment 1620 configured to spring-pop out while the user adjusts length, then release-spring-pop into place to substantially lock the device in place for further use. Securing pins, magnets, latches, press-fit, or other appropriate locking mechanisms may be acceptable, so long as they continue to allow the user to adjust the device in its (optionally retracted, and) extended position(s). "Index plunger" may also be broadened to include all appropriate varieties of detent pins.

Figure 18:
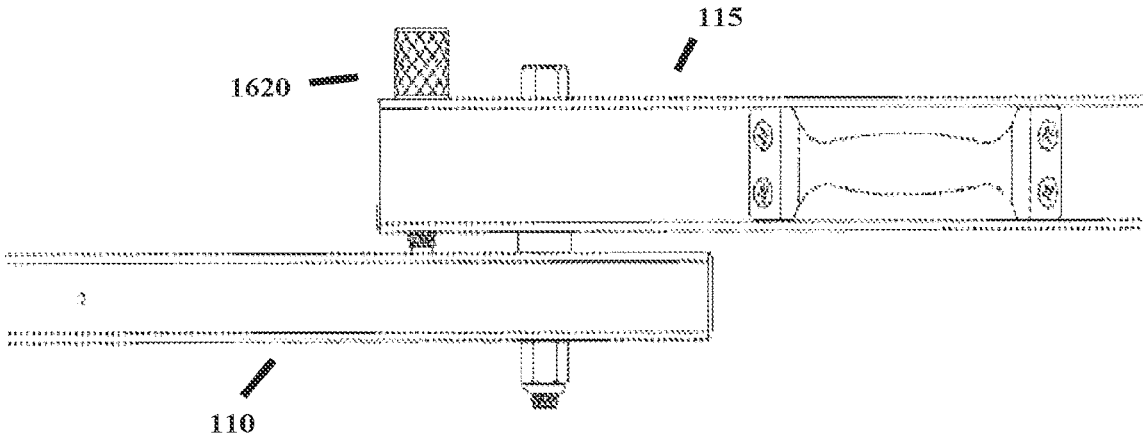
FIG. 18 is a top view of part of an exemplary base frame with an index plunger locking the pivotally connected tubes in place.
Figure 19:
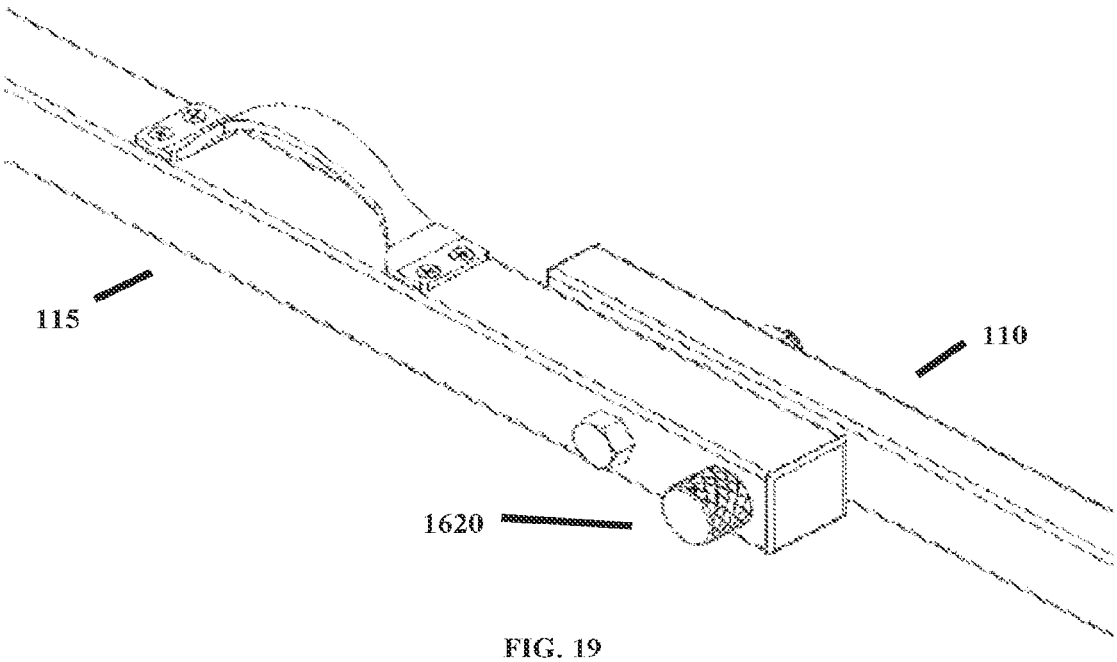
FIG. 19 is a perspective view of part of an exemplary base frame with an index plunger locking the pivotally connected tubes in place.

In some embodiment designs, the two U-shaped tubes may be connected pivotally to each other through a bolt and nut on either side where the tubes overlap. In an illustrative example, the bolt and bolt holes may be in the middle of the approximately 6 inch overlap between the two U tubes. In the embodiment depicted by FIG. 18 and FIG. 19, in addition to the two bolts and nuts, on one side of the base frame, the spring-loaded index plunger 1620 is operably configured to releasably lock the frame 107 first frame section 110 into place with the pivotally engaged second frame section 115. In the embodiment depicted by FIG. 18 and FIG. 19, the index plunger is located near the end of one of the larger U tubing ends, approximately 2 inches from the bolt and nut on the one side. In the embodiment depicted by FIG. 18 and FIG. 19, the pin used in the index plunger fully penetrates the larger tubing and enters the smaller tubing on the side closest to the larger tubing but does not travel through the entirety of the smaller tubing. In other embodiments, an index plunger or pin may be used that penetrates the entirety of both tubes. In an exemplary scenario illustrative of some embodiment designs' usage, when the exercise apparatus is in use, the upward pulling forces of the resistance bands applied to the base frame may cause the frame to fold up where they are connected pivotally. In such a scenario, the index plunger prevents this movement of the frame folding up where the tubes are pivotally connected and keeps the shape of the base frame intact. In the embodiment depicted by FIG. 17, the index plunger may also be used to lock the base frame into its folded position. Optional ridge/notches or latches, press-fit, or magnets may line the tubing walls to further facilitate secure locking in folded/retracted position.

In an example illustrative of various embodiment implementations, the upper body support may include approximately 1.5×1.5 inch tubing and have a fixed height of approximately 14 inches when referenced from the ground.

Figure 20:
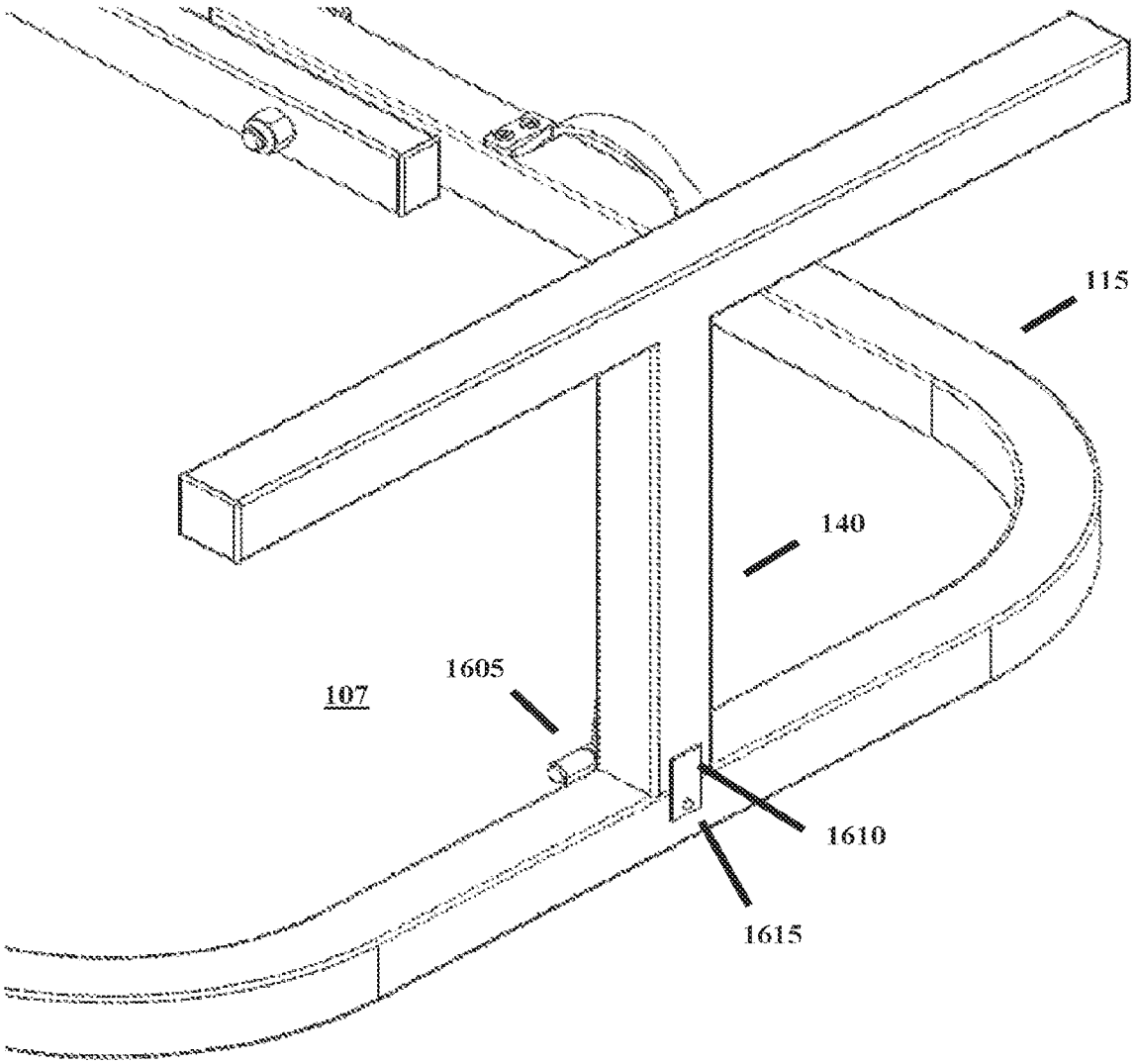
FIG. 20 is a perspective view of the back of an exemplary upper body support in an upright position, and part of an illustrative base frame. In the embodiment illustrated by FIG. 20, the index plunger is locked into the metal tab, which keeps the upper body support standing upright.

In the embodiment illustrated by FIG. 16, the upper body support pivotally attaches to the base frame via a T-strap hinge and when upright, protrudes from the top of the center of the middle of the larger U tube. In the embodiment depicted by FIG. 16, the upper body support resembles a capital letter 'T' and is made from approximately 1.5×1.5 16 gauge square tubing. In the embodiment illustrated by FIG. 16, the upper body support rests on top of the base frame when the upper body support is upright. In the embodiment depicted by FIG. 16, the hinge is fastened to the upper body support near the bottom of the side facing inward towards the exercise space. In the embodiment illustrated by FIG. 16, the hinge is also fastened to the base frame on the side facing inwards. In the embodiments depicted by FIG. 16 and FIG. 20, the spring-loaded index plunger 1605 is press fitted into the center of the backside of the base frame. In the embodiment illustrated by FIG. 20, attached to the center of the backside hanging over the bottom of the upper body support is a metal tab 1610 with the hole 1615 in it that receives the plunger when it is in an upright position, thus keeping it locked in place. In an illustrative example, a user can then push the plunger button in and fold down the upper body support, so that it rests inside the exercise space, in the same plane as the base frame.

In some embodiment designs, resistance bands may be attached to the frame at an attachment point(s). In various embodiment implementations, attachment point(s) may include two handles, with one handle fastened on each side of a larger U tube, with the center of each handle approximately 10 inches from the end of the approximately 24 inch length tubes. In some embodiment designs, the handles may be placed on top of the base frame, as illustrated, for example, in the embodiment depicted by FIG. 16. In an example illustrative of various embodiment designs' usage, resistance band(s) configured with a carabiner attachment on each resistance band end may be attached via the carabiner attachments to the handles illustrated in the embodiment depicted by FIG. 16. Said bands are customarily 321b bands, 451b bands, 701b bands, but any appropriate band is acceptable.

For example, a user may attach one end of the resistance to the left handle, and the other end of the resistance band to the right handle, or vice versa. Multiple attachment points are allowable, as the apparatus device is preferably designed for human bodies between 4'6" and 6' 10".

In some embodiment designs, exemplary resistance bands may be approximately 26 inches long. In an example illustrative of some embodiment designs' usage, a user may sit down in the empty space the base frame surrounds, with the user's upper back on the upper body support, and the user's feet on the foot support, and the attached resistance band resembles a belt that crosses over the user's lap, close to the user's hips. For example, the user may now perform a weighted hip thrust, by pushing upwards against the resistance band using the gluteal muscles.

Figure 15A:
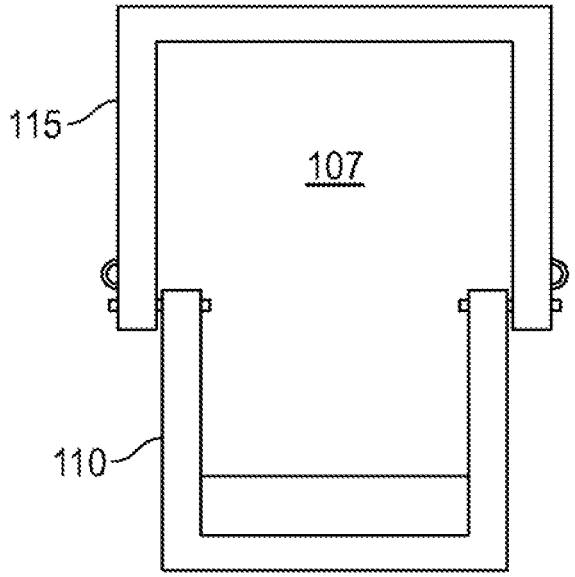
FIGS. 15A-15B are top views of an exemplary rectangular frame of an illustrative exercise apparatus that is connected pivotally according to various embodiments of the present invention, in both an open and folded configuration. Note that an upper body support is not depicted in this figure, but if it were, would be attached to the top side of the rectangular frame from this view. Also depicted in this embodiment is a foot support.
Figure 15B:
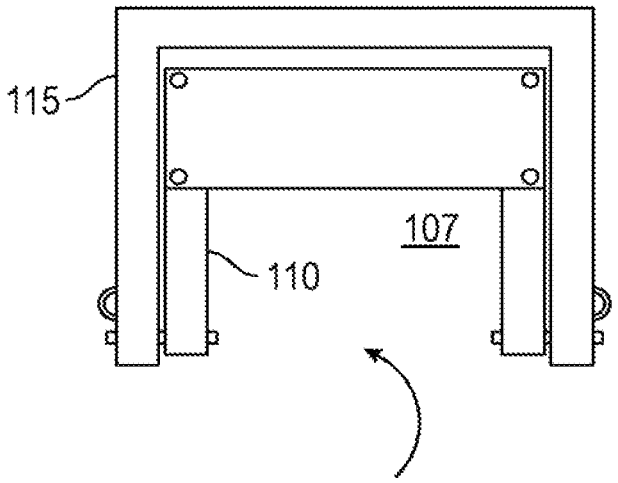

In some embodiments, a foldable base frame may have a foot support as depicted in FIGS. 15A-15B. In the embodiment illustrated by FIGS. 15A-15B, the foot support provides an area for the user to place his or her feet and allows the apparatus to accommodate varying user heights.

Figure 21:
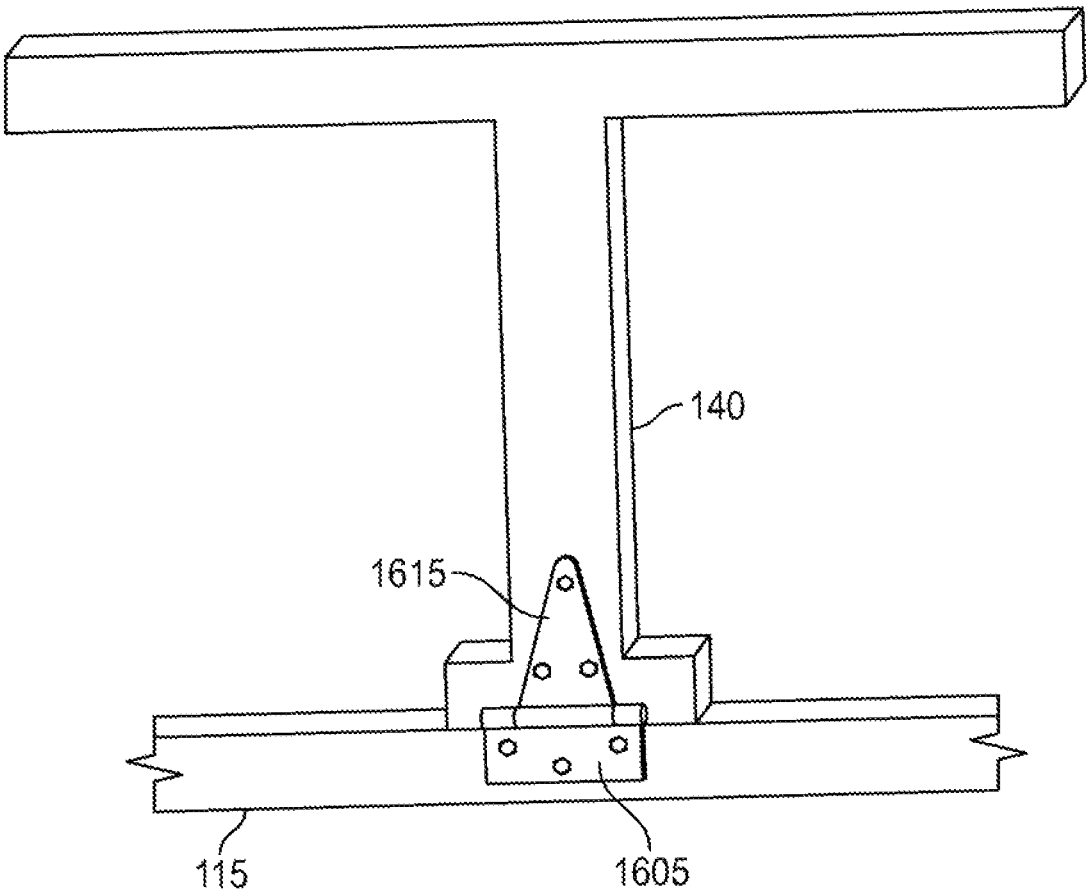
FIG. 21 is a perspective view of an exemplary upper body support connected pivotally to an exemplary base frame according to various embodiments of the present invention, in which the bottom of the support has a wide base. Note that the entire apparatus is not depicted in this figure.
Figure 22:
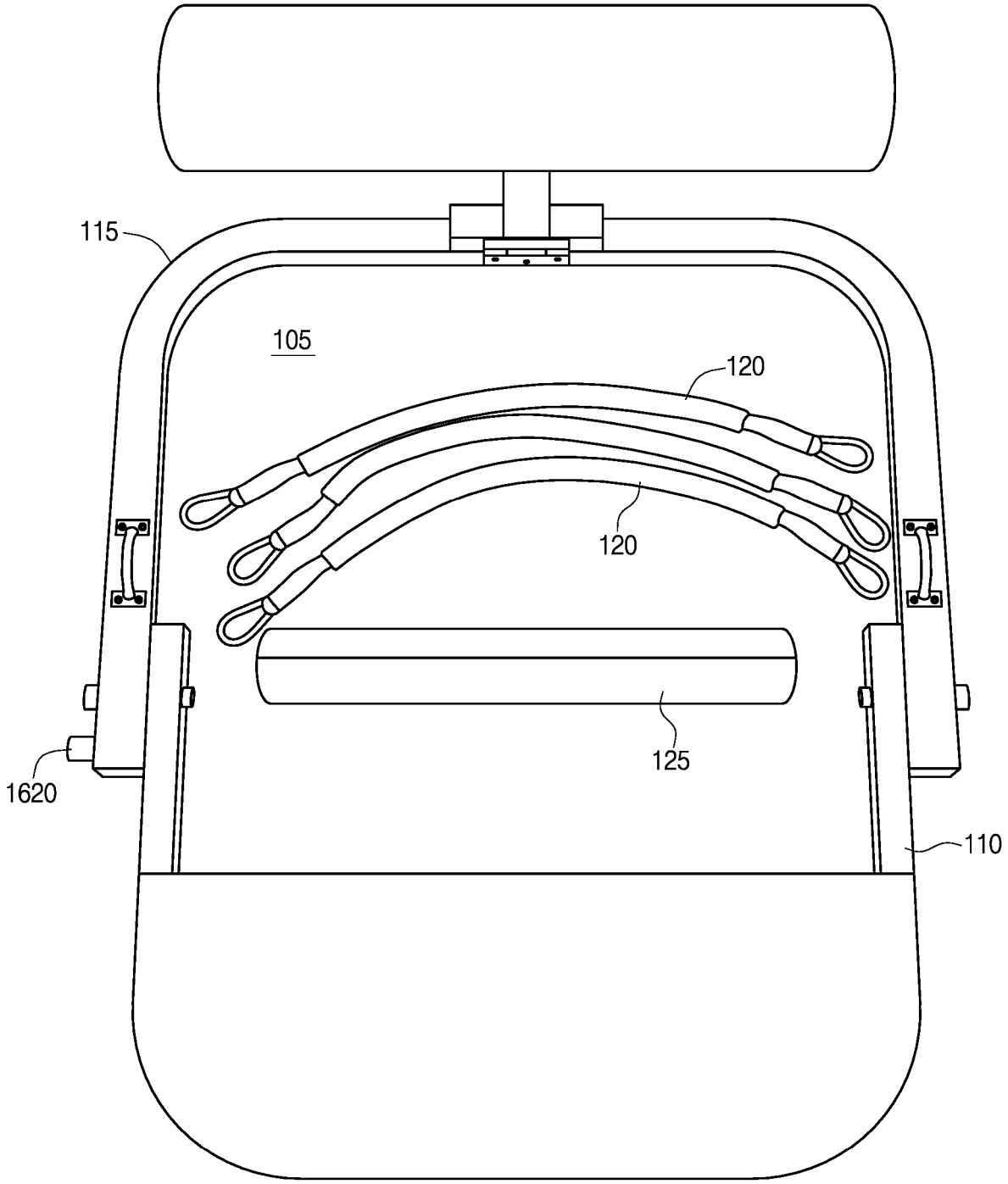
FIG. 22 is a top view of an exemplary exercise apparatus according to various embodiments of the present invention, where the resistance tubes are illustrated detached from the frame with the padded sleeve in an exemplary un-assembled configuration.
Figure 23:
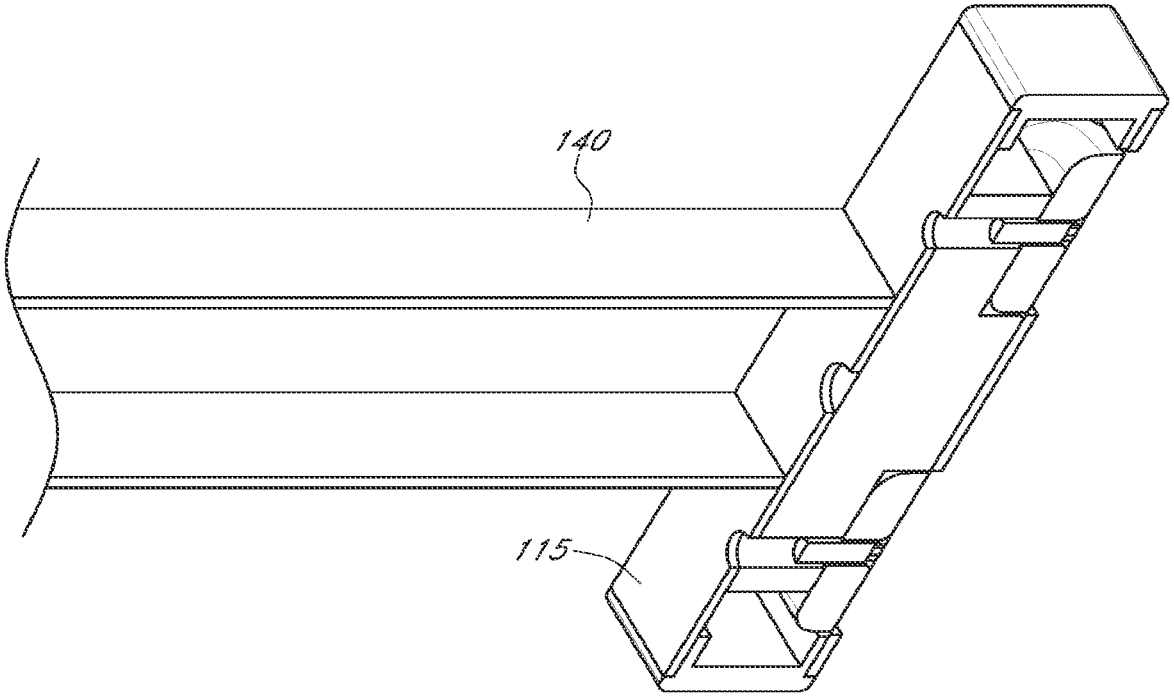
FIG. 23 is a perspective view of the back of an exemplary upper body support in an upright position, according to various embodiments of the present invention.

In various embodiment implementations, the upper body support may have a welded piece of tubing on the bottom of the T to prevent torqueing and/or twisting of the hinge when the upper body support is in the upright position, as illustrated, for example, in the embodiment depicted by FIG. 21.

Figure 24:
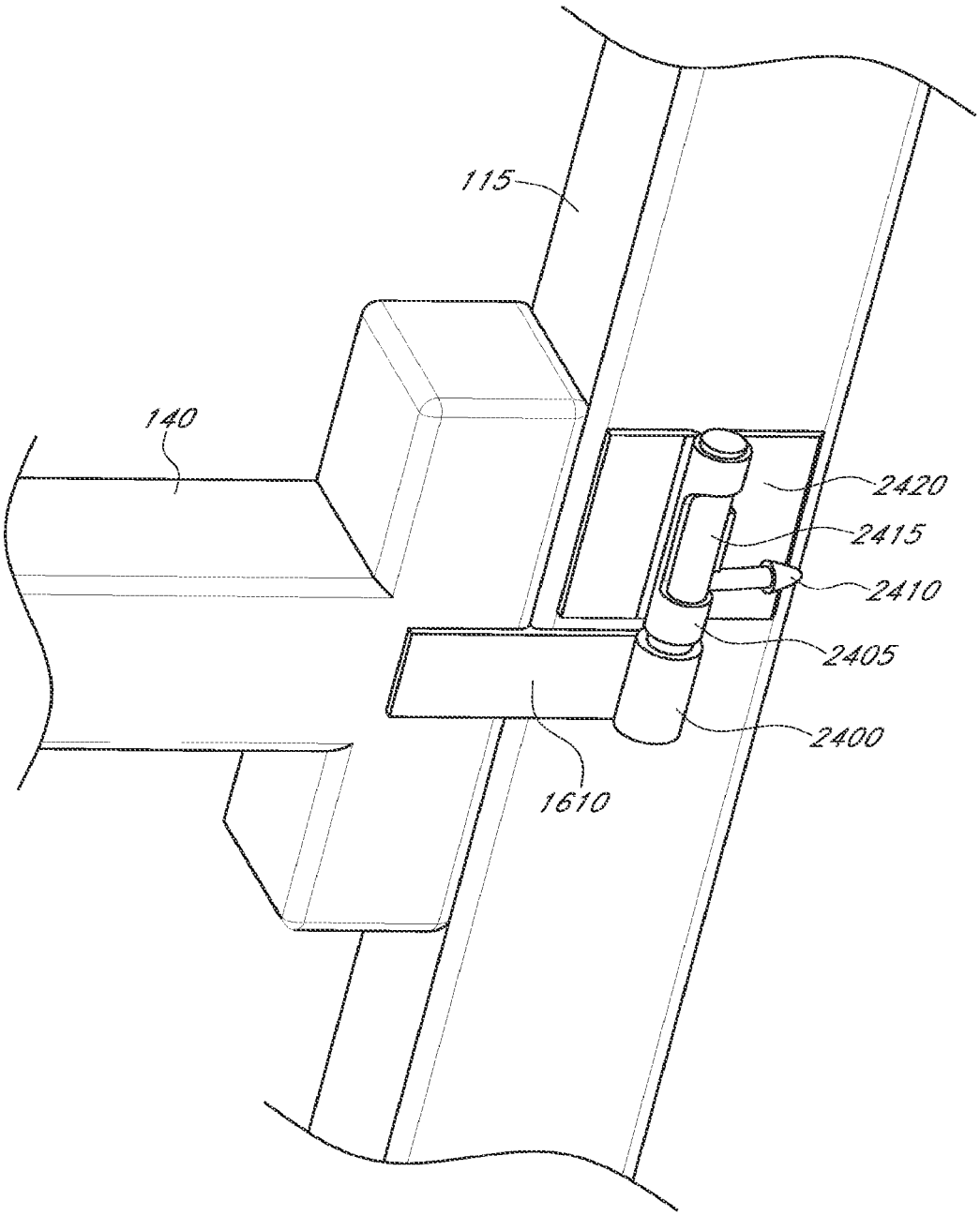
FIG. 24 is a perspective view of the back of an exemplary upper body support in an upright position, and part of an illustrative base frame.
Figure 25:
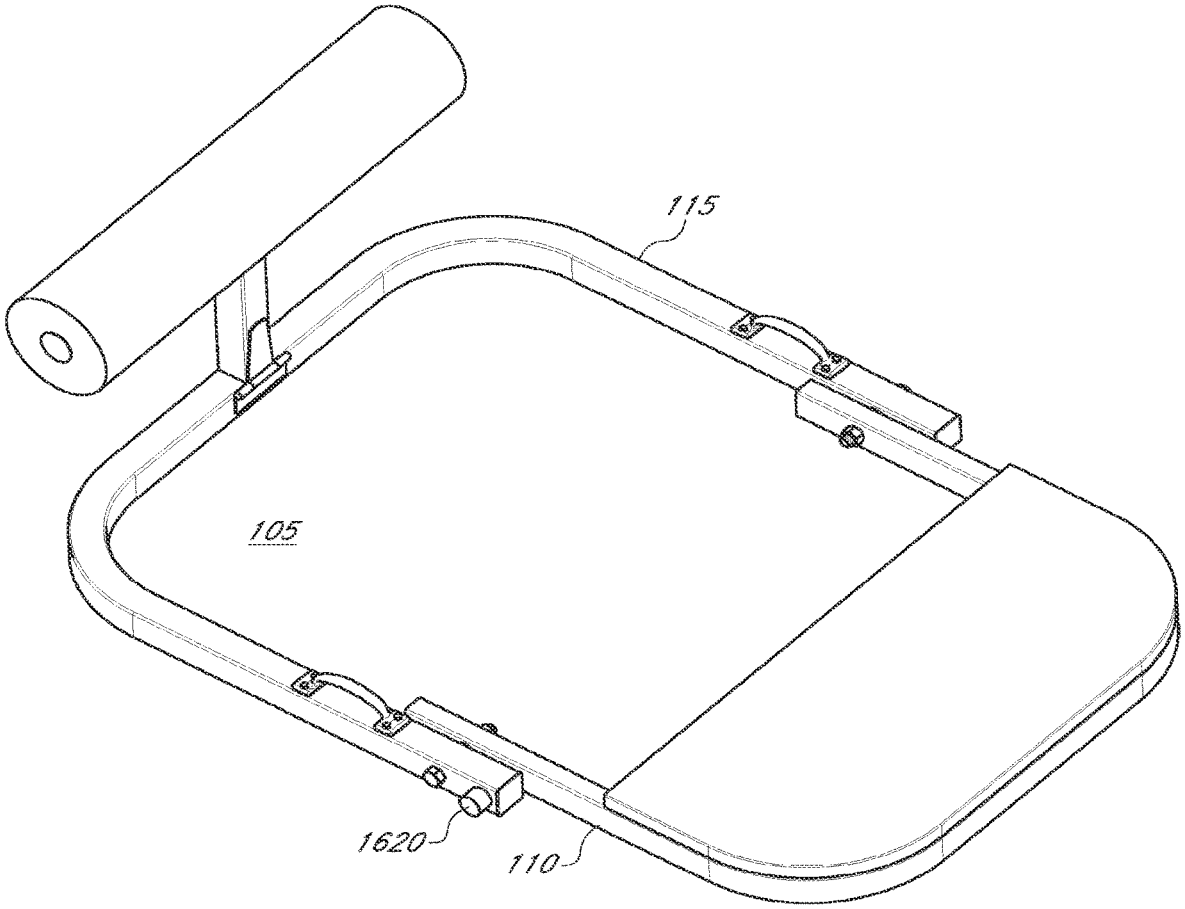
FIG. 25 is a perspective view of an exemplary exercise apparatus according to various embodiments of the present invention.
Figure 26:
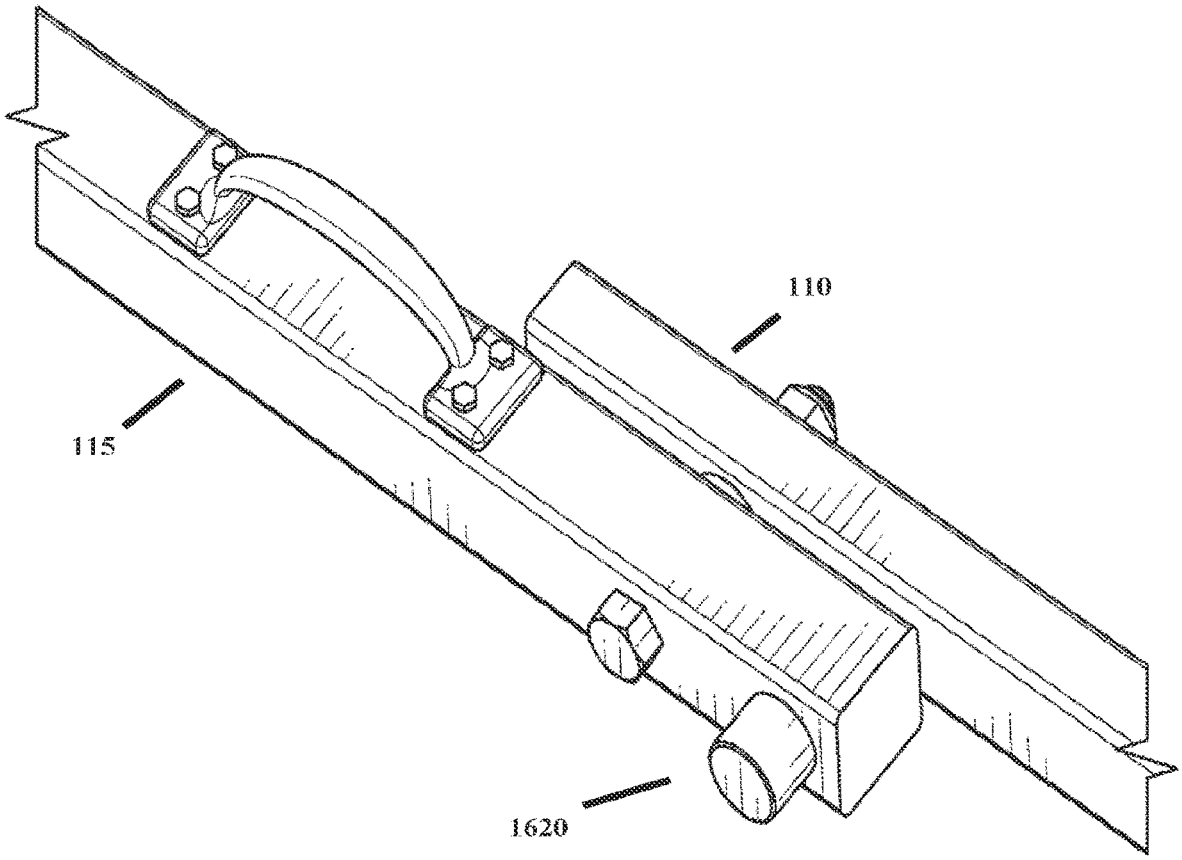
FIG. 26 is a perspective view of part of an exemplary base frame with an index plunger locking the pivotally connected tubes in place.
Figure 27:
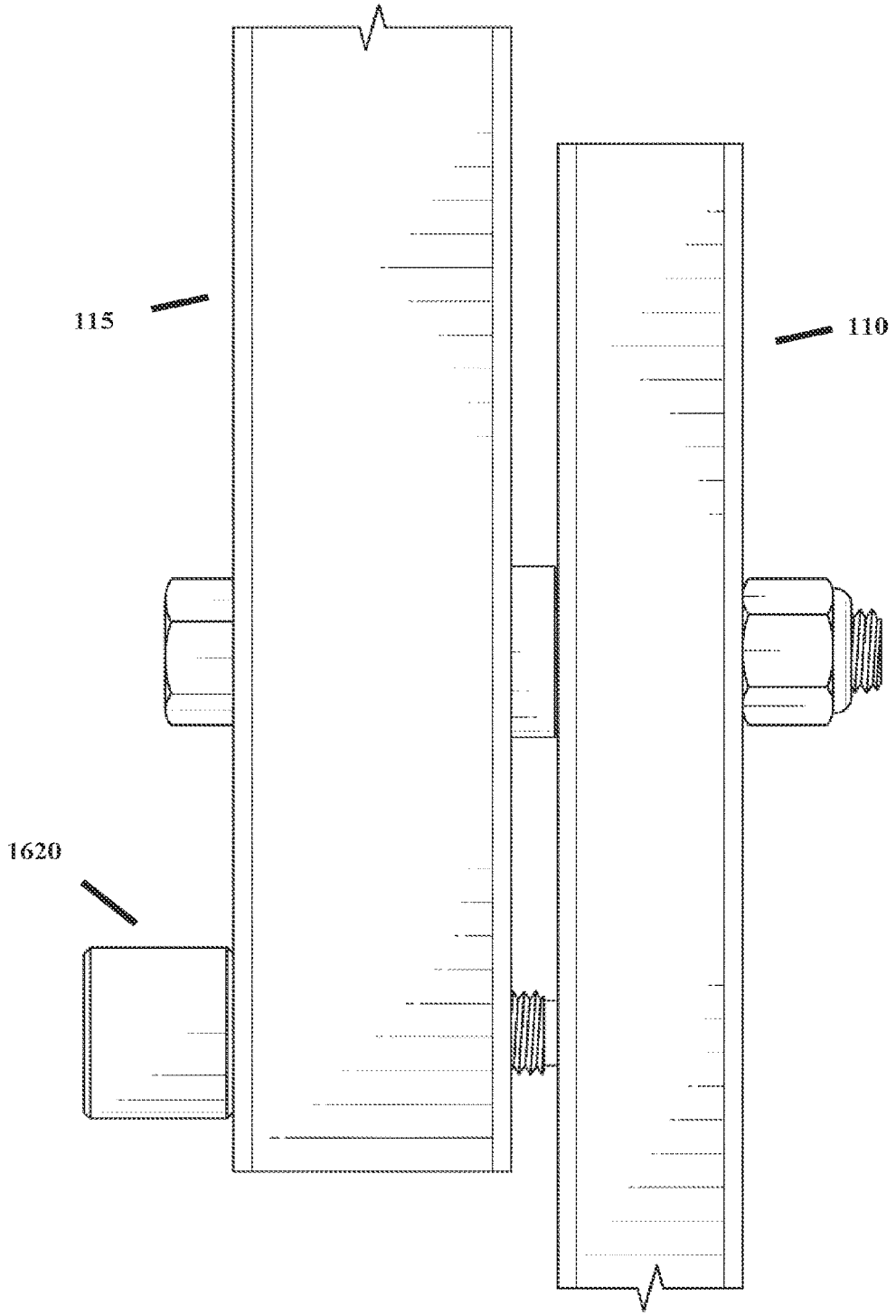
FIG. 27 is a top view of part of an exemplary base frame with an index plunger locking the pivotally connected tubes in place.
Figure 28:
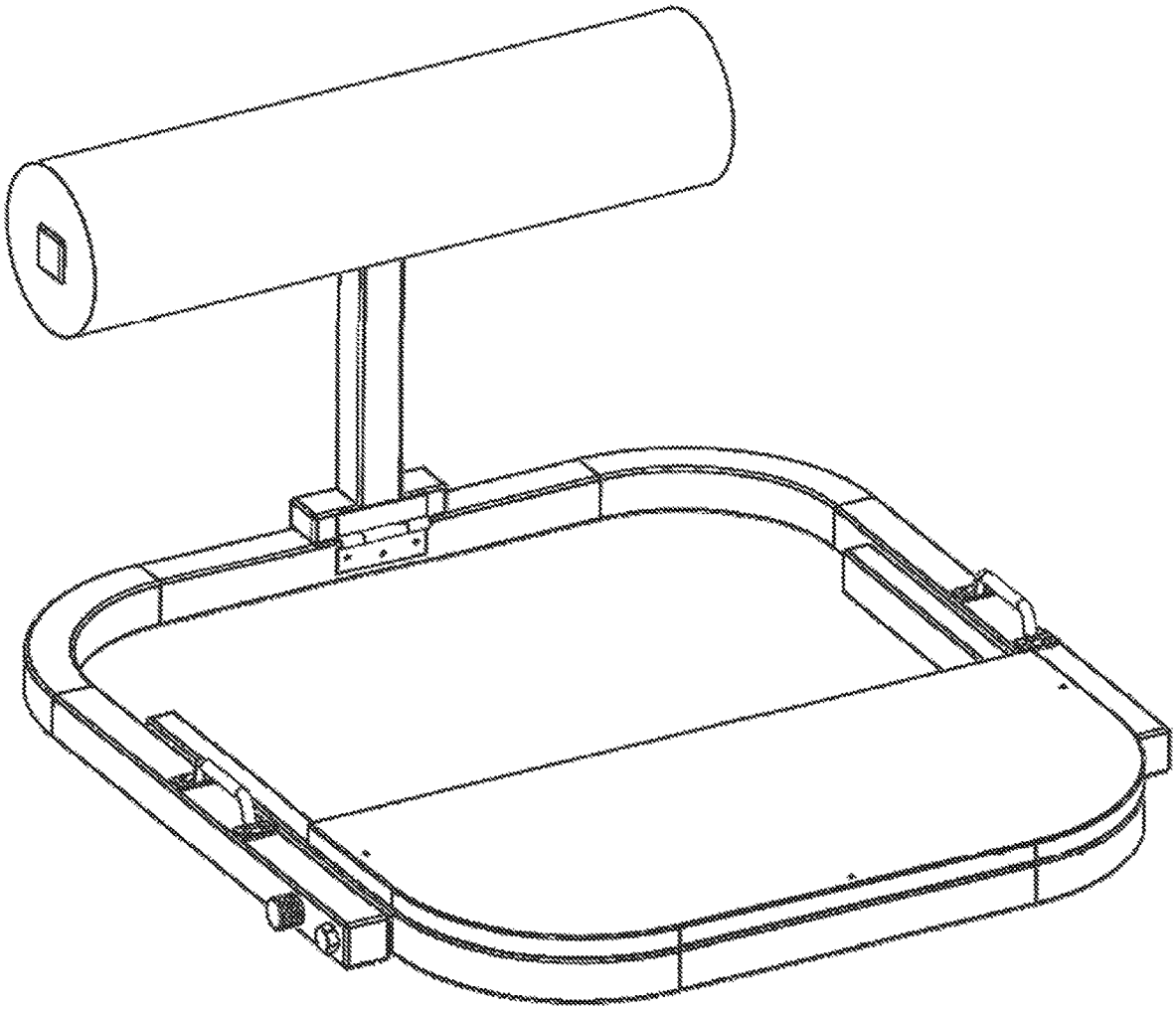
FIG. 28 is a top view of part of an exemplary base frame with detent pins locking the frame tubes in place.
Figure 29:
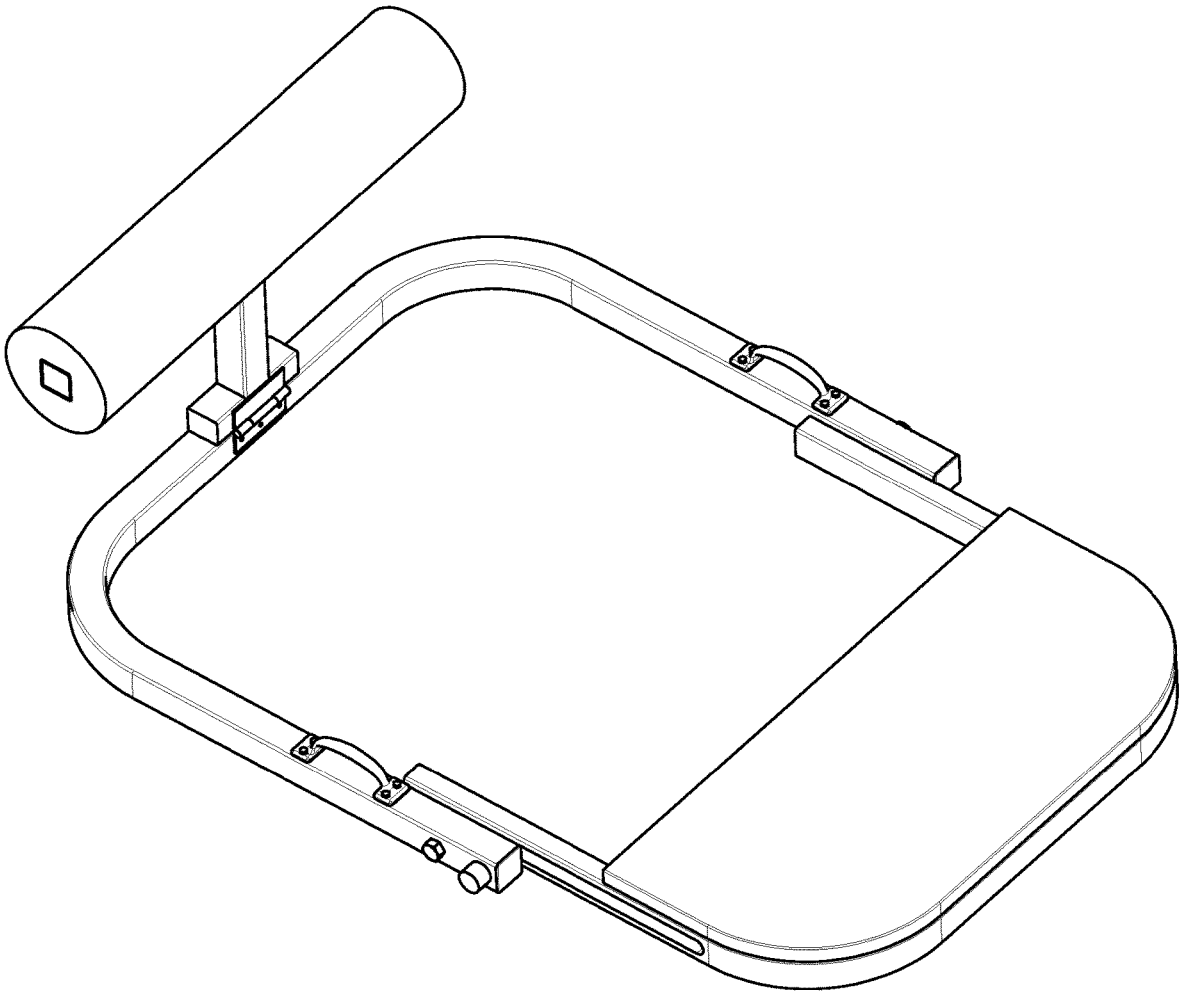
FIG. 29 is a top view of part of an exemplary base frame with detent pins locking the frame tubes in place.

In the embodiment depicted by FIG. 24, the index plunger 2405 is locked into the metal tab 1610 shaft retaining coupling 2400 by the spring pin 2410 along the shaft 2415. In the embodiment illustrated by FIG. 24, the spring pin 2410 along the shaft 2415 is rotationally engageable with the metal tab 1610 in at least two configurations. In the first configuration depicted by FIG. 24 wherein the shaft 2415 is extended and rotatably engaged in the securing slot 2420, the index plunger 2405 is locked into the metal tab 1610 by the spring pin 2410 along the shaft 2415, retaining the upper body support lower section 140 standing upright. In a second configuration the shaft 2415 may be rotatably disengaged from the securing slot 2420 and retracted, permitting the upper body support 140 lower section to pivot about a hinge axis longitudinally disposed substantially perpendicular to the long dimension of the upper body support 140 lower section, permitting the upper body support to be collapsible An embodiment of the invention is an exercise apparatus comprising a collapsible hip thrust exercise module, comprising a base frame, comprising a substantially tubular structure having size and shape configured to subsume a portion of a human torso, comprising: a first base frame section comprised substantially of adjustable-length slide tubing; and a second base frame section coupled with the first base frame section via slide tubing; and an upper body support, pivotally coupled with the base frame by an upper body support detent pin adjustable to configure the upper body support in a first locked upright upper body support mode and a second collapsible upper body support mode, based on releasably engaging the upper body support detent pin with a securing slot; and a resistance band releasably coupled with the base frame and an attached slider footrest piece, wherein the footrest slides into said telescopic tubing, and wherein said footrest piece adjusts and removably locks via detent pins.

SPECIFICATION & CLAIMS GENERALLY

Certain terminology in the enclosed description exist for convenience rather than limitation. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises," and grammatical equivalents thereof are used herein to mean that other components, ingredients, steps, among others, are optionally present. For example, an article "comprising" (or "which comprises") components A, B and C may consist of (i.e., contain only) components A, Band C, or may contain not only components A, B, and C but also contain one or more other components.

Where reference is made herein to a method comprising two or more defined steps, the defined steps may be carried out in any order or simultaneously (except where the context excludes that possibility), and the method may include one or more other steps which are carried out before any of the defined steps, between two of the defined steps, or after all the defined steps (except where the context excludes that possibility). The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or O as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Any element in a claim that does not explicitly state "means for" performing a specified function, or "step for" performing a specific function is not to be interpreted as a "means" or "step" clause as specified in 35. U.S.C. § 112 ¶ 6. Specifically, the use of "step of" in the claims herein is not intended to invoke the provisions of U.S.C. § 112 ¶ 6.

Aspects of the disclosed invention may be embodied as a system, method or process, or prompted by or used to transmit digital data to/via a computer program product. Accordingly, aspects of the disclosed invention may take the form of an entirely hardware embodiment, an entirely software embodiment (including firmware, resident software, micro-code, etc.) or an embodiment combining software and hardware aspects that may all generally be referred to herein as a "circuit," "module," "program," "device," or "system." Furthermore, aspects of the disclosed invention may take the form of [or produce signals for/receive digital information from] a computer program product embodied in one or more computer readable media having computer readable program code embodied thereon. Technology introduced herein may therefore be implemented by programmable circuitry (e.g., one or more microprocessors) programmed with software and/or firmware, or entirely in special-purpose hardwired (non-programmable) circuitry, or in a combination of such forms. Special-purpose hardwired circuitry may be in the form of, for example, one or more ASICs, PLDs, FPGAs, etc. to prompt or respond to data produced for/from the herein-disclosed exercise apparatus device.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

What is claimed is:

1. An apparatus, comprising:

a collapsible hip thrust exercise module, comprising:

a planar base frame comprising a tubular structure, the planar base frame having a size and polygonal shape or curved polygonal shape configured to house a portion of a human torso, the planar base frame comprising a first base frame section and a second base frame section coupled with the first base frame section;

an upper body support pivotally coupled with the planar base frame and having a first locked upright upper body support mode configured to provide an elevated back rest to the human torso and a second collapsed upper body support mode; and a resistance band operably coupled with the planar base frame.

2. The apparatus of claim 1, wherein the upper body support is pivotally coupled with the planar base frame by a hinge.

3. The apparatus of claim 2, wherein the upper body support is configured to rotate about the hinge to transition between the first locked upright upper body support mode and the second collapsed upper body support mode.

4. The apparatus of claim 3, further comprising a push button configured to stop the rotation to lock the upper body support in the first locked upright upper body support mode.

5. The apparatus of claim 1, wherein the first base frame section is telescopically coupled with the second base frame section.

6. The apparatus of claim 1, wherein the planar base frame further comprises a handle and wherein the resistance band is attached to said handle.

7. The apparatus of claim 1, wherein the resistance band is subsumed by a padded sleeve adapted to removably encase the resistance band.

8. The apparatus of claim 1, wherein at least one of the first and second base frame sections is adapted to receive an index plunger, which when received, locks the first and second base frame sections relative to one another.

9. The apparatus of claim 1, wherein the polygonal shape comprises a rectangular shape or wherein the curved polygonal shape comprises a curved rectangular shape.

10. The apparatus of claim 1, wherein the upper body support is perpendicular to the planar base frame when the upper body support is configured in the first locked upright upper body support mode.

11. The apparatus of claim 1, wherein the upper body support is positioned within an interior of the planar base frame when the upper body support is in the second collapsed upper body support mode.

12. The apparatus of claim 1, wherein the planar base frame has a fixed width and/or an adjustable length.

13. The apparatus of claim 1, wherein the first base frame section and the second base frame section include a first tube and a second tube, respectively, sized such that one of the first tube and the second tube is configured to be placed inside the other to form a telescopic tube.

* * * * *